US005246828A

United States Patent [19]

Okuyama et al.

[11] Patent Number: 5,246,828

[45] Date of Patent: Sep. 21, 1993

[54] LIGHT-SENSITIVE SILVER HALIDE PHOTOGRAPHIC MATERIAL

[75] Inventors: Masato Okuyama; Yukio Ohya, both of Odawara, Japan

[73] Assignee: Konica Corporation, Tokyo, Japan

[21] Appl. No.: 866,743

[22] Filed: Apr. 10, 1992

[30] Foreign Application Priority Data

Apr. 16, 1991 [JP] Japan ..... 3-082798
Dec. 3, 1991 [JP] Japan ..... 3-319411

[51] Int. Cl.[5] ..... G03C 1/08; G03C 1/20

[52] U.S. Cl. ..... 430/576; 430/584; 430/585; 430/586; 430/588; 430/600; 430/611; 430/614; 430/615

[58] Field of Search ..... 430/576, 584, 585, 586, 430/588, 600, 614, 615, 611

[56] References Cited

U.S. PATENT DOCUMENTS

| | | | |
|---|---|---|---|
| 2,875,058 | 2/1959 | Carroll et al. | 430/576 |
| 3,062,646 | 11/1962 | Dann et al. | 430/600 |
| 3,340,064 | 9/1967 | Riester | 430/582 |
| 3,457,078 | 7/1969 | Riester | 430/576 |
| 3,458,318 | 7/1969 | Brooks | 430/576 |
| 3,615,632 | 10/1971 | Shiba et al. | 430/576 |
| 3,695,888 | 10/1972 | Hiller et al. | 430/576 |
| 3,930,867 | 1/1976 | Bigelow | 430/600 |
| 4,011,083 | 3/1977 | Durning et al. | 430/584 |
| 4,670,377 | 6/1987 | Miyoshi et al. | 430/584 |
| 5,089,382 | 2/1992 | Sakai | 430/584 |

FOREIGN PATENT DOCUMENTS 61-203447 9/1986 Japan .

*Primary Examiner*—Janet C. Baxter
*Attorney, Agent, or Firm*—Frishauf, Holtz, Goodman & Woodward

[57] ABSTRACT

Disclosed is a light-sensitive silver halide photographic material having at least one silver halide emulsion layer on a support, wherein (1) the silver halide emulsion is spectrally sensitized by a red-sensitive sensitizing dye and contains a macrocyclic compound having at least one hetero atom, (2) a number of aliphatic rings forming the macrocyclic compound is 4 or less, and (3) the macrocyclic compound has an aromatic ring, which has good aging storage stability and excellent safelight safety characteristics, and can provide high sensitivity stably.

14 Claims, No Drawings

LIGHT-SENSITIVE SILVER HALIDE PHOTOGRAPHIC MATERIAL

BACKGROUND OF THE INVENTION

This invention relates to a light-sensitive silver halide photographic material, more specifically to a light-sensitive silver halide photographic material having a red-sensitive silver halide emulsion layer which has high sensitivity and also is improved in variation of photographic sensitivity caused by storing a raw sample for a long time and variation of gradation caused by light of a safelight.

Demands to a light-sensitive silver halide photographic material have become more strict year by year. In addition to strong demands of high sensitivity and high image quality (particularly excellent graininess and sharpness), low replenishing processing suitability for reducing environmental pollution and rapid processability to cope with demand of finishing within a short time have been strongly demanded. Most of these demands have been met by making a silver halide grain highly sensitive, and it is no exaggeration to say that high sensitivity of a silver halide grain is the largest task in this field of the art.

As one method of obtaining high sensitivity, it has been known that supersensitization is useful The supersensitization is described in "Photographic Science and Engineering", vol. 13, pp. 13 to 17 (1969), ibid, vol. 18, pp. 418 to 430 (1974), and "The Theory of the Photographic Process", edited by T. H. James, 4th edition, published by McMillan Co., 1977, p. 259, and it has been known that high sensitivity can be obtained by selecting a suitable sensitizing dye and a suitable supersensitizer.

In the prior art, as a supersensitizer for a red-sensitive spectral sensitizing dye, there have been known, for example, many compounds such as a stilbene, an azaindene, a mercapto hetero ring, a thiourea or a condensate of phenol and hexamethylenetetramine, and they have been disclosed in, for example, U.S. Pat. Nos. 2,875,058, 3,340,064, 3,457,078, 3,458,318, 3,615,632, 3,695,888 and 4,011,083, and Japanese Provisional Patent Publication No. 203447/1986.

However, it has been found that when a red-sensitive silver halide emulsion is supersensitized according to these prior techniques, variation deterioration of photographic sensitivity caused by natural storage is large, and further, when a light-sensitive material is exposed to light of a safelight before printing, gradation becomes soft. Since photographic characteristics are required to be uniform, aging stability in a raw sample of a light-sensitive photographic material is extremely important, and also safelight safety characteristics are extremely important from the standpoints of handling property of a light-sensitive material and prevention of lowering in quality of a finished print, so that a novel sensitizing method without bad influence on storage stability and safelight safety characteristics even when supersensitization is carried out has been demanded.

SUMMARY OF THE INVENTION

Thus, an object of the present invention is to provide a red-sensitive light-sensitive silver halide photographic material having high sensitivity, good aging storage stability in a raw sample, excellent safelight safety characteristics and stable photographic characteristics.

The present inventors have investigated intensively, and consequently found that the object of the present invention can be accomplished by the present invention described below, to accomplish the objects of the present invention.

That is, the above object can be accomplished by (1) a light-sensitive silver halide photographic material having at least one silver halide emulsion layer on a support, wherein said silver halide emulsion is spectrally sensitized by a red-sensitive sensitizing dye and contains a macrocyclic compound having at least one hetero atom, (2) the light-sensitive silver halide photographic material described in the above (1) wherein a number of aliphatic rings forming the above macrocyclic compound having a hetero atom(s) is 4 or less, and (3) the light-sensitive silver halide photographic material described in the above (1) wherein the above macrocyclic compound having a hetero atom(s) has an aromatic ring.

DESCRIPTION OF THE PREFERRED EMBODIMENTS

In the following, the present invention is explained in detail.

The red-sensitive sensitizing dye mentioned in the present specification refers to a cyanine dye, a composite cyanine and a composite merocyanine such as cyanine, merocyanine and holopolar, preferably refers to a cyanine dye(s) represented by the following formula (I) and/or (II).

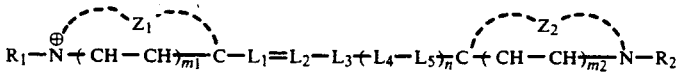

(I)

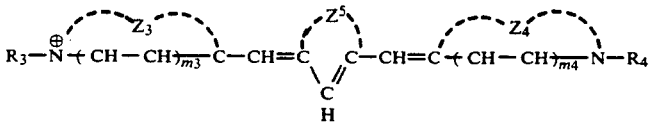

(II)

(wherein $R_1$, $R_2$, $R_3$ and $R_4$ each represent an alkyl group, an alkenyl group or an aryl group; $L_1$, $L_2$, $L_3$, $L_4$ and $L_5$ each represent methyne group; $Z_1$, $Z_2$, $Z_3$ and $Z_4$ each represent an atom or an atomic group necessary for completing a 5- or 6-membered heterocyclic nucleus; $Z_5$ represents a hydrocarbon group necessary for forming a 6-membered ring; $m_1$, $m_2$, $m_3$ and $m_4$ each represent 0 or 1; n represents 0 or 1; $X^-$ represents an acidic anion; and $Y_1$ and $Y_2$ each represent 0 or 1, and when a compound forms a intramolecular salt, $Y_1$ and $Y_2$ each represent 0.

In the sensitizing dye to be used in the present invention, the alkyl group represented by $R_1$, $R_2$, $R_3$ and $R_4$ of the formula (I) or (II) may be straight or branched. The alkyl group is more preferably an alkyl group having 10 or less carbon atoms, and may have a substituent(s). As the substituent, there may be mentioned each group of sulfo, aryl, carboxy, (primary, secondary or tertiary) amine, alkoxy, aryloxy, hydroxy, alkoxycarbonyl, acyloxy, acyl, aminocarbonyl or cyano, and a halogen atom. As a specific example of the alkyl group, there may be mentioned methyl group, ethyl group, propyl group, butyl group, pentyl group, hexyl group, heptyl group, sulfoethyl group, sulfopropyl group, sulfobutyl group, benzyl group, phenethyl group, carboxyethyl group, carboxymethyl group, dimethylaminopropyl group, methoxyethyl group, phenoxypropyl group, methylsulfonylethyl group, p-t-butylphenoxyethyl group, cyclohexyl group, octyl group, decyl group, carbamoylethyl group, sulfophenethyl group, sulfobenzyl group, 2-hydroxy-3-sulfopropyl group, ethoxycarbonylethyl group, 2,3-disulfopropoxypropyl group, sulfopropoxyethoxyethyl group, trifluoroethyl group, carboxybenzyl group, cyanopropyl group, p-carboxyphenethyl group, ethoxycarbanylmethyl group, pivaloylpropyl group, propionylethyl group, anisyl group, acetoxyethyl group, benzoyloxypropyl group, chloroethyl group, morpholinoethyl group, acetylaminoethyl group, N-ethylaminocarbonylpropyl group and cyanoethyl group.

The alkenyl group is preferably an alkenyl group having 10 or less carbon atoms, for example, allyl group, 2-butenyl and 2-propynyl group.

The aryl group is, for example, phenyl group, carboxyphenyl group and sulfophenyl group.

The methyne group represented by $L_1$, $L_2$, $L_3$, $L_4$ and $L_5$ of the formula (I) or (II) may have a substituent, and when it has a substituent, it is represented by the formula (—$CR_5$=). As the group represented by $R_5$, there may be mentioned a straight or branched alkyl group having 1 to 8 carbon atoms which may be substituted (e.g. methyl group, ethyl group, propyl group, butyl group and benzyl group), an alkoxy group (e.g. methoxy group and ethoxy group) and an aryl group (e.g. phenyl group and tolyl group).

As the anion represented by $X^-$ of the formulae (I) and (II), there may be mentioned, for example, chlorine ion, bromine ion, iodine ion, perchloric acid ion, fluoroboric acid ion, p-toluenesulfonic acid ion, ethylsulfonic acid ion, methylsulfonic acid ion and nitric acid ion.

Among the sensitizing dyes represented by the above formula (I) or (II), the particularly useful sensitizing dyes may be represented by the following formulae (III) and (IV).

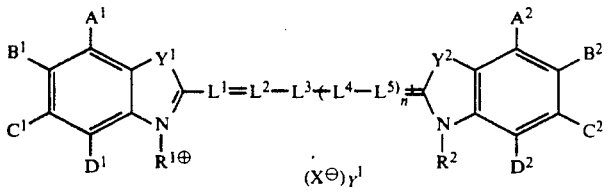

(III)

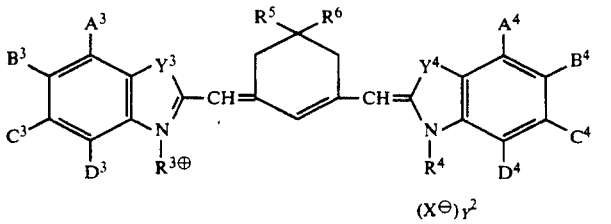

(IV)

(wherein $Y^1$, $Y^2$, $Y^3$ and $Y^5$ each represent oxygen atom, sulfur atom or selenium atom; $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ each represent hydrogen atom, a halogen atom, an alkyl group, an alkoxy group, a phenyl group, cyano group, nitro group or an alkoxycarbonyl group, and at least one combination of $A^1$ and $B^1$, $B^1$ and $C^1$, $C^1$ and $D^1$, $A^2$ and $B^2$, $B^2$ and $C^2$, $C^2$ and $D^2$, $A^3$ and $B^3$, $B^3$ and $C^3$, $C^3$ and $D^3$, $A^4$ and $B^4$, $B^4$ and $C^4$, and $C^4$ and $D^4$ may be bonded to form a benzene ring; $R^5$ and $R^6$ each represent a lower alkyl group; $R^1$, $R^2$, $R^3$, $R^4$, $L^1$, $L^2$, $L^3$, $L^4$, $L^5$, $X^-$, $n^1$, $Y^1$ and $Y^2$ each have the same meanings as those of $R_1$, $R_2$, $R_3$, $R_4$, $L_1$, $L_2$, $L^2$, $L_3$, $L_4$, $L_5$, $X^-$, n, $Y_1$ and $Y_2$ in the above formula (I) or (II)).

The alkyl group represented by $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ in the formula (III) or (IV) includes a straight or branched lower alkyl group which may be substituted having 1 to 5 carbon atoms (e.g. methyl group, ethyl group, propyl group, butyl group and trifluoromethyl group); the alkoxy group includes a straight or branched alkoxy group having 1 to 5 carbon atoms (e.g. methoxy group and ethoxy group); the halogen atom includes each atom of fluorine, chlorine, bromine and iodine; the phenyl group includes, for example, phenyl group having no substituent, hydroxyphenyl group and carboxyphenyl group; and the alkoxycarbonyl group includes, for example, methoxycarbonyl group and ethoxycarbonyl group. $n^1$ represents 0 or 1, preferably 1.

Specific suitable examples of the red-sensitive sensitizing dye of the present invention are shown below, but the present invention is not limited to these.

TABLE 1

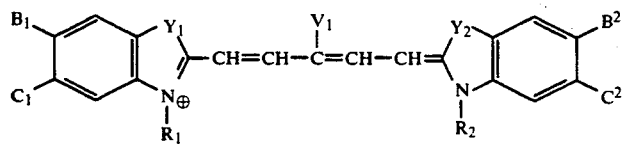

$X^{\ominus}$

| Exemplary No. | $Y_1$ | $Y_2$ | $B_1$ | $C_1$ | $B_2$ | $C_2$ | $R_1$ | $R_2$ | $V_1$ | $X^-$ |
|---|---|---|---|---|---|---|---|---|---|---|
| I-1 | Se | Se | H | H | H | H | $C_2H_5$ | $C_2H_5$ | H | I |
| I-2 | S | S | H | H | H | H | $C_2H_5$ | $C_2H_5$ | H | I |
| I-3 | Se | Se | H | H | H | H | $(CH_2)_2OCH_3$ | $(CH_2)_2OCH_3$ | H | Br |
| I-4 | Se | S | H | H | H | H | $(CH_2)_3SO_3H$ | $C_2H_5$ | H | — |
| I-5 | S | S | H | $OCH_3$ | H | H | $C_2H_5$ | $C_2H_4OH$ | $C_2H_5$ | Br |
| I-6 | S | S | $C_2H_5$ | H | $C_2H_5$ | H | $C_5H_{11}$ | $C_5H_{11}$ | $C_2H_5$ | Br |
| I-7 | S | S | $C_2H_5$ | H | $C_2H_5$ | H | $C_5H_{11}$ | $C_5H_{11}$ | $C_4H_9$ | Br |
| I-8 | S | S | $OCH_3$ | $OCH_3$ | $OCH_3$ | $OCH_3$ | $C_2H_5$ | $C_2H_5$ | $CH_3$ | I |

I-9

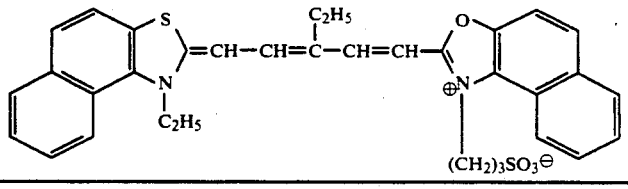

TABLE 2

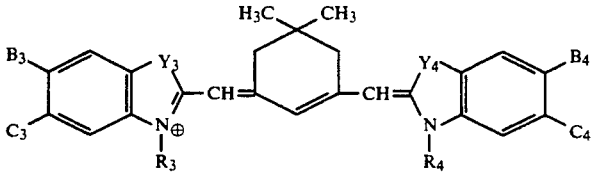

$X^{\ominus}$

| Exemplary No. | $Y_3$ | $Y_4$ | $B_3$ | $C_3$ | $B_4$ | $C_4$ | $R_3$ | $R_4$ | $X^-$ |
|---|---|---|---|---|---|---|---|---|---|
| II-1 | S | S | H | H | H | H | $C_2H_5$ | $C_2H_5$ | Br |
| II-2 | S | S | $CH_3$ | H | H | H | $C_2H_5$ | $C_2H_5$ | Br |
| II-3 | S | S | $CH_3$ | H | $CH_3$ | H | $C_2H_5$ | $C_2H_5$ | I |
| II-4 | S | S | H | H | H | H | $C_2H_5$ | $C_3H_7$ | I |
| II-5 | S | S | H | H | H | H | $C_2H_5$ | $C_4H_9$ | I |
| II-6 | S | S | H | H | H | H | $C_2H_5$ | $C_5H_{11}$ | Br |
| II-7 | S | S | H | H | H | H | $C_2H_5$ | $C_7H_{15}$ | Br |
| II-8 | S | S | H | H | H | H | $C_2H_5$ | $C_{10}H_{21}$ | Br |
| II-9 | S | S | H | H | H | H | $C_3H_7$ | $C_3H_7$ | Br |
| II-10 | S | S | H | H | H | H | $C_4H_9$ | $C_4H_9$ | $PTS^{-*}$ |
| II-11 | S | S | H | H | H | H | $C_5H_{11}$ | $C_5H_{11}$ | Br |
| II-12 | S | S | H | H | H | H | $C_7H_{15}$ | $C_7H_{15}$ | Br |
| II-13 | S | S | $CH_3$ | H | H | H | $C_2H_5$ | $C_5H_{11}$ | Br |
| II-14 | S | S | $CH_3$ | H | $CH_3$ | H | $C_2H_5$ | $C_5H_{11}$ | Br |
| II-15 | S | S | $OCH_3$ | H | H | H | $C_2H_5$ | $C_2H_5$ | Br |
| II-16 | S | S | $OCH_3$ | H | H | H | $C_2H_5$ | $C_5H_{11}$ | Br |
| II-17 | S | S | $CH_3$ | $CH_3$ | $CH_3$ | $CH_3$ | $C_2H_5$ | $C_2H_5$ | Br |
| II-18 | S | S | $C_3H_7(i)$ | H | $C_3H_7(i)$ | H | $C_2H_5$ | $C_2H_5$ | Br |
| II-19 | S | S | H | H | H | H | $C_2H_5$ | $(CH_2)_3SO_3^-$ | — |
| II-20 | S | S | $CH_3$ | H | $CH_3$ | H | $C_2H_5$ | $(CH_2)_4SO_3^-$ | — |
| II-21 | S | S | $CH_3$ | H | $CH_3$ | H | $(CH_2)_3SO_3H.N(C_2H_5)_3$ | $(CH_2)_3SO_3^-$ | — |
| II-22 | S | O | H | H | H | H | $C_2H_5$ | $C_2H_5$ | Br |
| II-23 | S | O | $CH_3$ | H | $CH_3$ | H | $C_2H_5$ | $C_5H_{11}$ | Br |
| II-24 | Se | Se | H | H | H | H | $C_2H_5$ | $C_2H_5$ | Br |
| II-25 | Se | Se | $CH_3$ | H | $CH_3$ | H | $C_2H_5$ | $C_2H_5$ | Br |

II-26

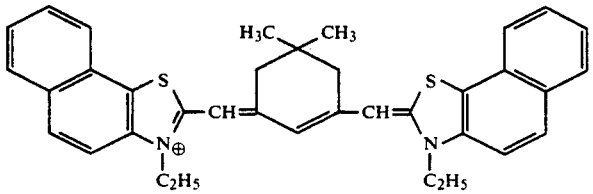

$I^{\ominus}$

TABLE 2-continued

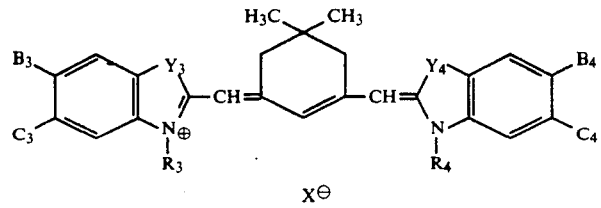

| Exemplary No. | $Y_3$ | $Y_4$ | $B_3$ | $C_3$ | $B_4$ | $C_4$ | $R_3$ | $R_4$ | $X^-$ |
|---|---|---|---|---|---|---|---|---|---|
| II-27 | | | | | | | | | |

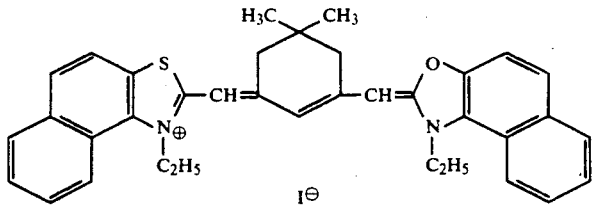

(*PTS: paratoluenesulfonic acid)

The above red-sensitive sensitizing dye can be synthesized easily according to, for example, the method described in F. M. Hermer, "The Chemistry of Heterocyclic Compounds", vol. 18, "The Cyanine Dyes and Related Compounds" (edited by A. Weissherger, published by Interscience Co., New York, 1964).

In the present invention, the amount of the red-sensitive sensitizing dye to be added is not particularly limited, but preferably $2\times10^{-8}$ mole to $1\times10^{-2}$ mole per mole of silver halide.

The macrocyclic compound having a hetero atom of the present invention is a not less than 9-membered macrocyclic compound containing at least one of nitrogen atom, oxygen atom, sulfur atom and selenium atom as a hetero atom. As a representative compound, there may be mentioned a crown ether in which a large number of compounds mentioned below are synthesized since Pedersen synthesized the compound and reported unique characteristics therof in 1967. These compounds are described in detail in C. J. Pedersen, "Journal of American Chemical Society" vol. 86 (2495), 7017 to 7036 (1967), G. W. Gokel, S. H. Korzeniowski, "Macrocyclic polyether synthesis", Springer-Verlag. (1982), "Chemistry of Crown Ether" edited by Oda, Shono and Tabuse, Kagaku Dojin (1978), Tabuse et al. "Host-Guest" Kyoritsu Shuppan (1979) and Sasaki and Koga, "Organic Synthetic Chemistry", vol. 45 (6), 571 to 582 (1987).

Specific examples of the macrocyclic compound containing a hetero atom to be used in the present invention are shown below, but the present invention is not limited to these.

S-1

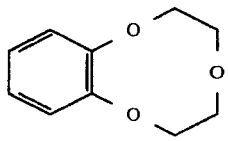

S-2

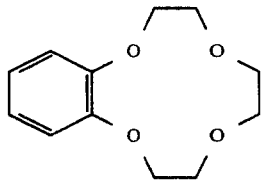

S-3

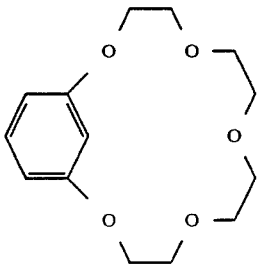

-continued
S-4
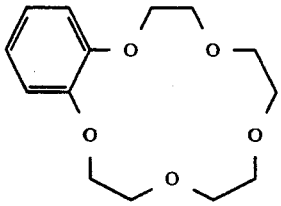
S-5
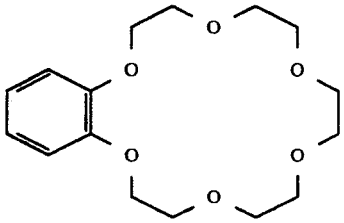
S-6
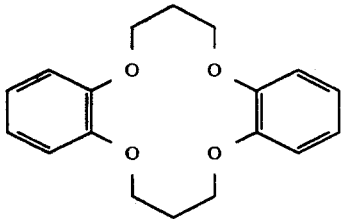
S-7
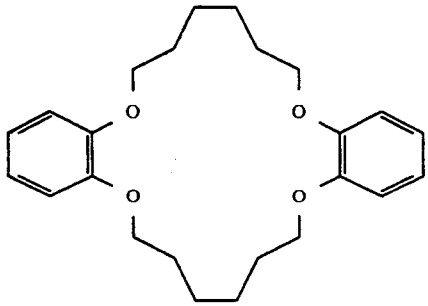
S-8
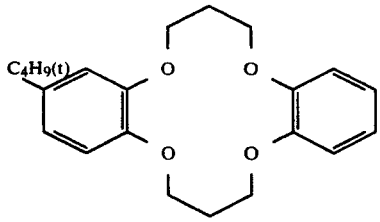
S-9
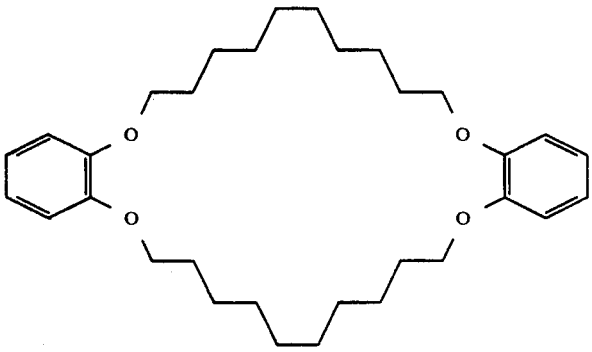

-continued
S-10
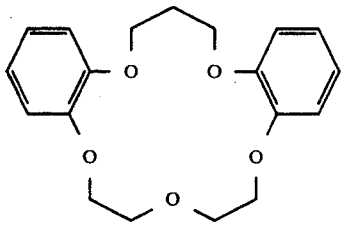
S-11
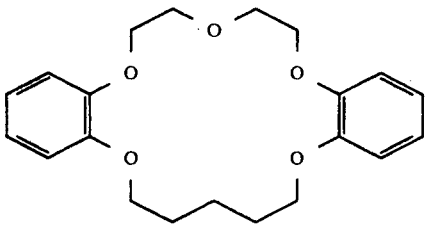
S-12
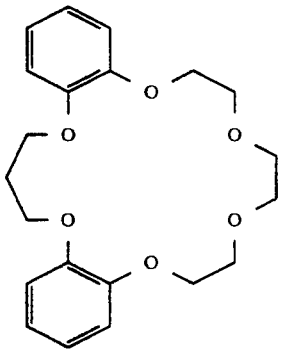
S-13
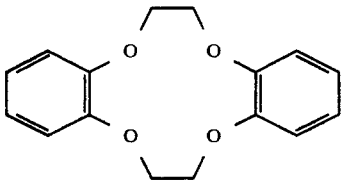
S-14
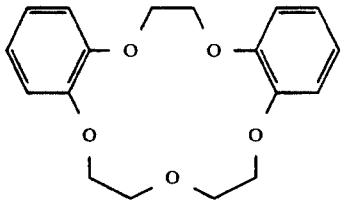
S-15
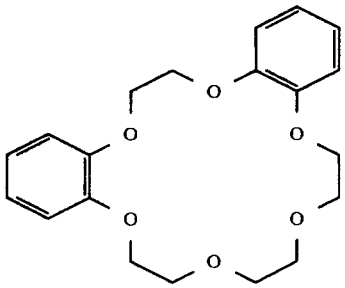

-continued
S-16
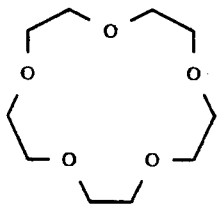
S-17
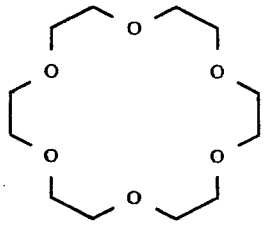
S-18
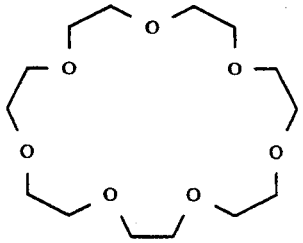
S-19
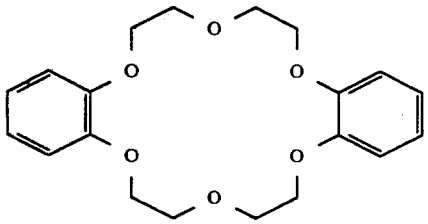
S-20
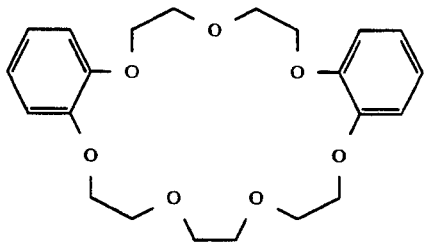
S-21
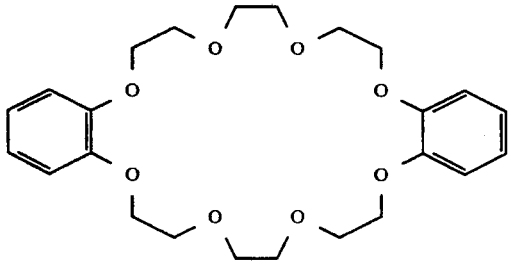

-continued
S-22
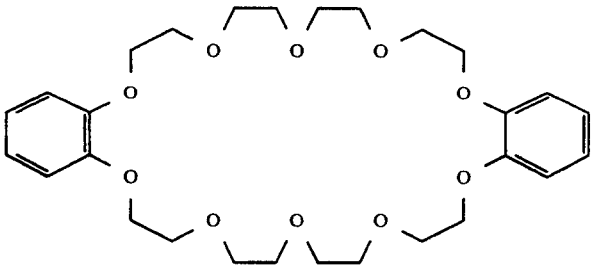
S-23
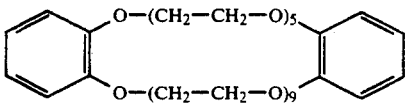
S-24
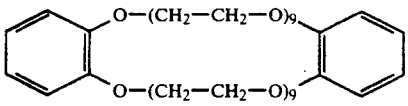
S-25
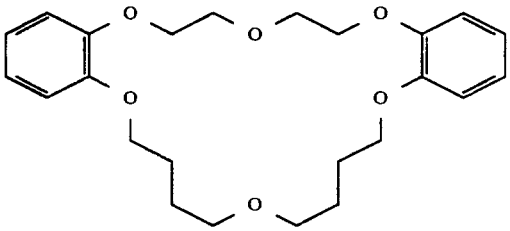
S-26
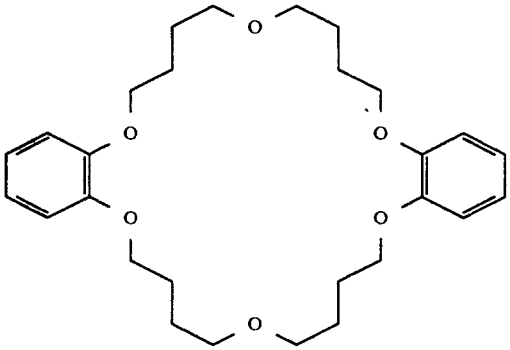
S-27
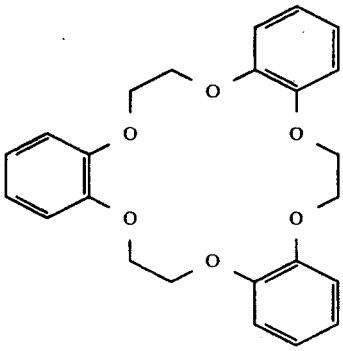

-continued
S-28
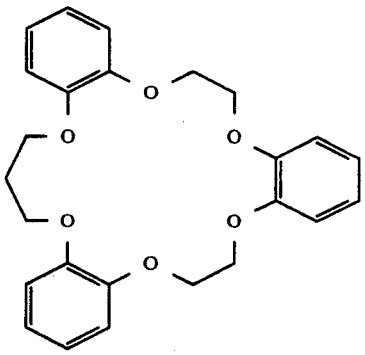
S-29
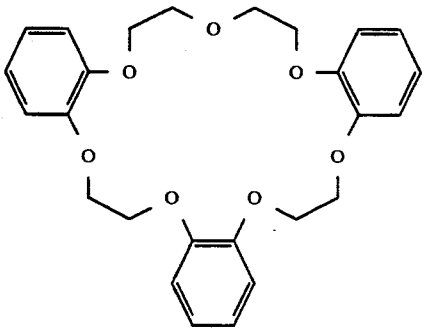
S-30
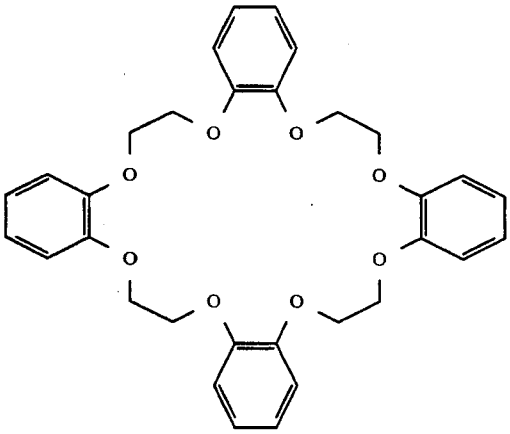
S-31
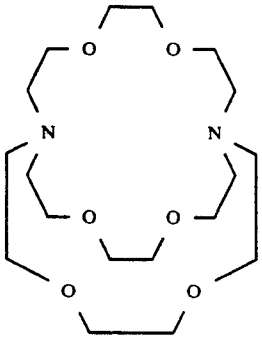

-continued
S-32
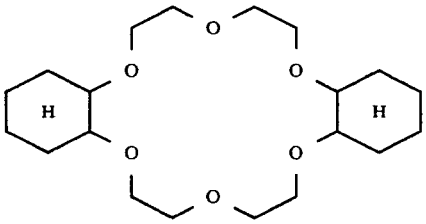
S-33
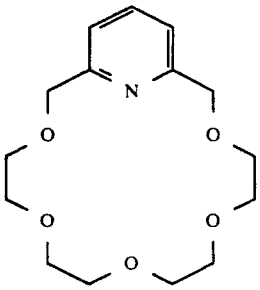
S-34
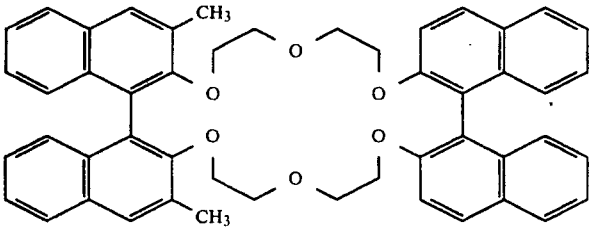
S-35
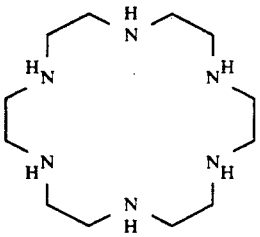
S-36
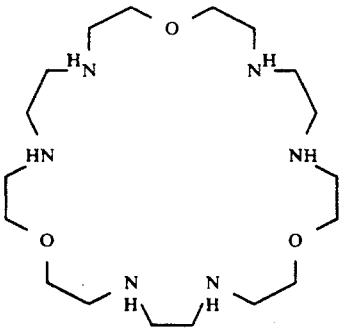
S-37
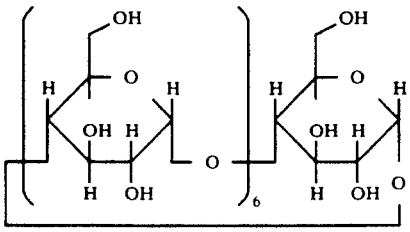

-continued
S-38
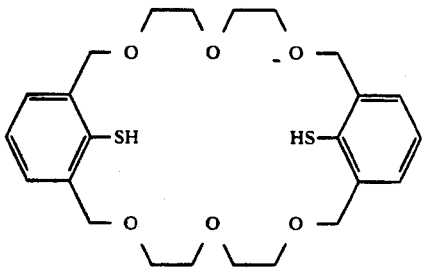
S-39
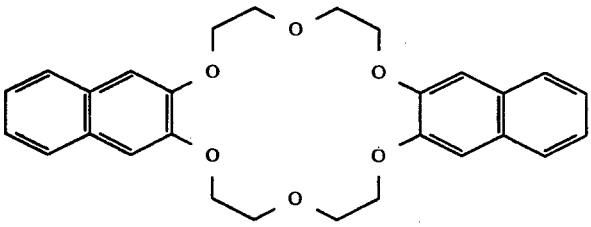
S-40
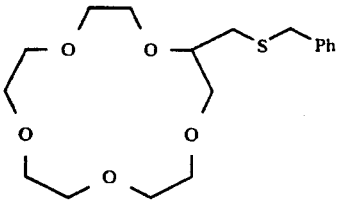
S-41
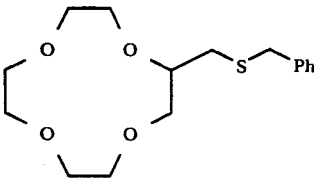
S-42
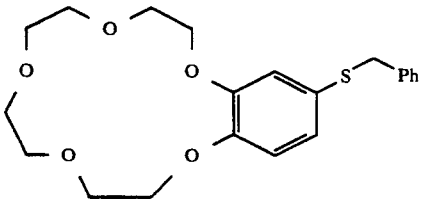
S-43
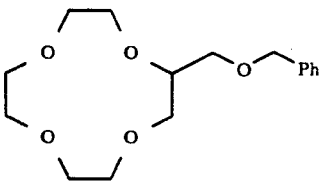
S-44
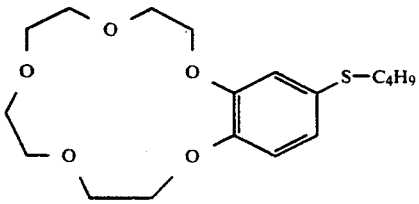

-continued

S-45

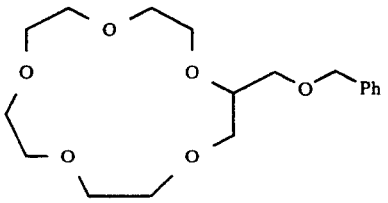

For adding the macrocyclic compound having a hetero atom of the present invention to a hydrophilic colloid containing silver halide grains, it may be added after dissolving it in water or a hydrophilic organic solvent such as methanol, ethanol and fluorinated alcohol. The time of addition may be any time before coating of an emulsion, but preferably before completion of chemical sensitization.

Either of the red-sensitive sensitizing dye or the macrocyclic compound may be added previously, and they may be added simultaneously or added as a mixture. The amount of the macrocyclic compound of the present invention to be added varies depending on the kind of the compound, but generally in the $1\times10^{-6}$ to $1\times10^{-1}$ mole, preferably $5\times10^{-6}$ to $1\times10^{-2}$ mole per mole of silver halide.

The silver halide to be used in the present invention includes any desired silver halide such as silver chloride, silver bromide, silver iodide, silver chlorobromide, silver iodobromide and silver chloroiodobromide. The silver halide grain preferably used in the present invention is silver chlorobromide, more preferably silver chlorobromide containing 0.01 to 2mole % of silver bromide. The silver halide grain may have a uniform composition from the internal portion to the external portion of the grain, or a different composition between the internal portion and the external portion of the grain. When the compositions of the internal portion and the external portion of the grain are different, the composition may be changed continuously or discontinuously. The grain may have a local phase having a different halide composition locally as disclosed in Japanese Provisional Patent Publication No. 183647/1989.

The grain size of the silver halide grain is not particularly limited, but preferably 0.2 to 1.6 μm, more preferably in the range of 0.25 to 1.2 μm in consideration of other photographic characteristics such as rapid processability and sensitivity. When the above grain is a sphere or has a shape similar to a sphere, the grain size is a grain diameter, and in the case of a cubic grain, the grain size is an edge length and represented by an average value based on a projected area. The grain size distribution of the silver halide grain may be polydispersed or monodispersed. There may be preferred a monodispersed silver halide grain having a grain size distribution with its variation coefficient being 0.22 or less, more preferably 0.15 or less.

In the present invention, the silver halide grain to be used in an emulsion may be a grain obtained according to any of acidic method, neutral method and ammoniacal method. Said grain may be grown at a time, or may be grown after forming a seed grain. The silver halide grain to be used in the present invention may have any desired shape. A preferred one example is a cube having a {100} face as a crystal surface. There may be also used a grain having a shape such as an octahedron, tetradecahedron or dodecahedron, or a grain having a shape such as a sphere, bar or plate. Further, a grain having a twin face may be used.

The silver halide material to be used in the present invention preferably has a blue-sensitive silver halide emulsion layer and a green-sensitive silver halide emulsion layer in addition to the red-sensitive silver halide emulsion layer. These layers are optically sensitized by using a sensitizing dye.

As the sensitizing dye, there may be used a cyanine dye, a merocyanine dye, a composite cyanine dye, a composite merocyanine dye, a holopolar cyanine dye, a hemicyanine dye, a styryl dye and a hemioxanol dye. The sensitizing dyes may be used alone or in combination of two or more of them. In an emulsion, there may be contained together with the sensitizing dye, a supersensitizer for strengthening sensitizing effect of the sensitizing dye, which is a dye having no spectral sensitizing effect itself or a compound substantially absorbing no visible light.

Further, these sensitizing dyes may be used not only for the inherent purpose of spectral sensitizing effect but also for the purposes of tone adjustment and development adjustment.

To the silver halide emulsion of the present invention, an antifoggant or a stabilizer may be added during chemical ripening, at the time of completion of chemical ripening, and/or during after completion of chemical ripening and before coating of the silver halide emulsion for the purposes of preventing fog during preparation, storage or photographic processing of a light-sensitive material, or maintaining photographic characteristics stably.

As a binder of the light-sensitive silver halide photographic material to be used in the present invention, there may be advantageously used gelatin, but if necessary, there may be also used a hydrophilic colloid such as a gelatin derivative, a graft polymer of gelatin and other polymers, or other proteins, sugar derivatives, cellulose derivatives and synthetic hydrophilic polymers including homopolymers or copolymers.

In the light-sensitive silver halide photographic material according to the present invention, dye-forming couplers such as a yellow coupler, a magenta coupler and a cyan coupler are used.

In the present invention, as the yellow coupler, there may be preferably used acylacetanilide type couplers Among them, benzoylacetanilide type and pivaloylacetanilide type compounds are advantageous, and particularly preferably used are Exemplary compounds Y-1 to Y-146 disclosed in Japanese Provisional Patent Publication No. 85631/1988, Exemplary compounds Y-1 to Y-98 disclosed in Japanese Provisional Patent Publication No. 97951/1988 and Exemplary compounds Y-1 to Y-24 disclosed in Japanese Provisional Patent Publication No. 156748/1989 (pp. 67 to 78).

As the magenta coupler which can be used in the present invention, there may be mentioned oil protective couplers of indazolone type or cyanoacetyl type, preferably 5-pyrazolone type and pyrazoloazole type such as pyrazolotriazoles. The magenta coupler preferably used in the present invention includes the magenta couplers represented by the following formulae (M-I) and (M-XI).

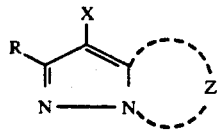
(M-I)

In the formula, Z represents a non-metallic atomic group necessary for forming a nitrogen-containing heterocyclic ring, and the ring formed by said Z may have a substituent(s). X represents hydrogen atom or a group which is eliminatable by reaction with an oxidized product of a color developing agent.

R represents hydrogen atom or a substituent. The substituent represented by R is not particularly limited, but representatively includes each group of alkyl, aryl, anilino, acylamino, sulfonamido, alkylthio, arylthio, alkenyl and cycloalkyl, and additionally includes a halogen atom and each group of cycloalkenyl, alkynyl, heterocyclic ring, sulfonyl, sulfinyl, phosphonyl, acyl, carbamoyl, sulfamoyl, cyano and alkoxy.

As a specific example of the compound represented by the formula (M-I), there may be mentioned M-1 to M-61 disclosed on page 5, right lower column to page 9, left lower column of Japanese Provisional Patent Publication No. 167360/1988 and Compounds No. 1 to No. 4, No. 6, No. 8 to No. 17, No. 19 to No. 24, No. 26 to No. 43, No. 45 to No. 59, No. 61 to No. 104, No. 106 to No. 121, No. 123 to No. 162 and No. 164 to No. 223 among the compounds disclosed on page 18, right upper column to page 32, right upper column of Japanese Provisional Patent Publication No. 166339/1987.

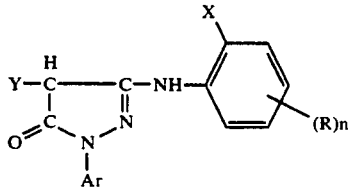
(M-XI)

In the formula, Ar represents an aryl group, X represents a halogen atom, an alkoxy group or an alkyl group, and R represents a group which can substitute on a benzene ring. n represents 1 or 2. When n is 2, Rs may be the same groups or different groups. Y represents a group which is eliminatable by the coupling reaction with an oxidized product of an aromatic primary amine type color developing agent.

In the formula (M-XI), Y is a group which is eliminatable by the coupling reaction with an oxidized product of an aromatic primary amine type color developing agent, and includes, for example, a halogen atom, alkoxy group, aryloxy group, acyloxy group, arylthio group, alkylthio group and a 5- to 6- membered heterocyclic group. Here, Y does not represent hydrogen atom.

As the coupler represented by the formula (M-XI), there may be mentioned, for example, Exemplary compounds No. 218 to No. 244 disclosed in Japanese Provisional Patent Publication No. 52138/1988, and further the couplers disclosed in U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and No. 3,933,500, Japanese Provisional Patent Publications No. 29639/1974, No. 111631/1974, No. 129538/1974, No. 13041/1975, No. 58922/1977, No. 62454/1980, No. 118034/1980, No. 38043/1981, No. 35858/1982, No. 2953/1985 3855/1985 and No. 60644/1985, U.K. Patent No. 1,247,493, Belgium Patents No. 789,116 and No. 792,525, West German Patent No. 21 56 111, and Japanese Patent Publications No. 60479/1971 and No. 36577/1982.

As the cyan coupler, there may be used a phenol type cyan coupler and a naphthol type cyan coupler. The cyan coupler preferably used in the present invention includes the cyan couplers represented by the following formulae (C-I) and (C-II).

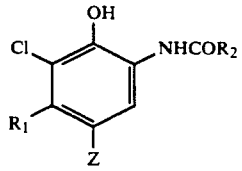
(C-I)

In the formula, $R_1$ represents an alkyl group having 2 to 6 carbon atoms. $R_2$ represents a ballast group. Z represents hydrogen atom, or an atom or a group which is eliminatable by the reaction with an oxidized product of a color developing agent. The alkyl group represented by $R_1$ may be straight or branched, and includes those having a substituent(s).

The ballast group represented by $R_2$ is an organic group having such a size and a shape that a sufficient volume to substantially prevent a coupler from being diffused from a layer in which the coupler is used to other layers can be given to a coupler molecule.

The preferred ballast group is that represented by the following formula.

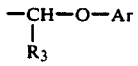

$R_3$ represents an alkyl group having 1 to 12 carbon atoms. Ar represents an aryl group such as phenyl group, and the aryl group includes those having a substituent(s). As a specific example of the cyan coupler represented by the formula (C-I), there may be mentioned Exemplary compounds PC-1 to PC-19 disclosed on pages 116 to 119 of Japanese Provisional Patent Publication No. 156748/1989, Exemplary compounds C-1 to C-28 disclosed in Japanese Provisional Patent Publication No. 249151/1987, and further the cyan couplers disclosed in Japanese Patent Publication No. 11572/1974, and Japanese Provisional Patent Publications No. 3142/1986, No. 9652/1986, No. 9653/1986, No. 39045/1986, No. 50136/1986, No. 99141/1986 and No. 105545/1986.

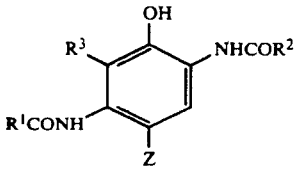

(C-II)

In the formula, $R^1$ represents an alkyl group or an aryl group. $R^2$ represents an alkyl group, a cycloalkyl group, an aryl group or a heterocyclic group. $R^3$ represents hydrogen atom, a halogen atom, an alkyl group or an alkoxy group. $R^3$ may form a ring with $R^1$. Z represents hydrogen atom or a group which is eliminatable by the reaction with an oxidized product of an aromatic primary amine type color developing agent.

In the cyan coupler represented by the above formula (C-II), the alkyl group represented by $R^1$ is preferably those having 1 to 32 carbon atoms, and they may be straight or branched and include those having a substituent(s). The aryl group represented by $R^1$ is preferably phenyl groups including those having a substituent(s). The alkyl group represented by $R^2$ is preferably those having 1 to 32 carbon atoms, and these alkyl groups may be straight or branched and also include those having a substituent(s). The cycloalkyl group represented by $R^2$ is preferably those having 3 to 12 carbon atoms, and these cycloalkyl groups include those having a substituent(s). The aryl group represented by $R^2$ is preferably phenyl groups including those having a substituent(s). The heterocyclic group represented by $R^2$ is preferably 5- to 7-membered groups including those having a substituent(s), which may be fused.

$R^3$ represents hydrogen atom, a halogen atom, an alkyl group or an alkoxy group, and said alkyl group and said alkoxy group include those having a substituent(s). $R^3$ is preferably hydrogen atom.

Further, the ring formed by $R^1$ and $R^3$ in combination is preferably a 5- to 6-membered ring, and as an example thereof, there may be mentioned

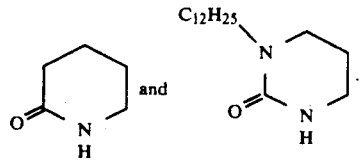

As the group which is eliminatable by the reaction with an oxidized product of a color developing agent, represented by Z in the formula (C-II), there may be mentioned a halogen atom, alkoxy group, aryloxy group, acyloxy group, sulfonyloxy group, acylamino group, sulfonylamino group, alkoxycarbonyloxy group, aryloxycarbonyloxy group and imido group (each including those having a substituent(s)), preferably a halogen atom, aryloxy group and alkoxy group.

Among the cyan couplers described above, particularly preferred is the coupler represented by the following formula (C-II-A).

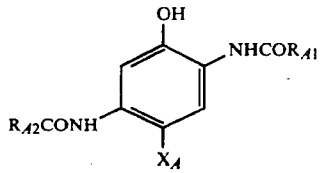

(C-II-A)

In the formula, $R_{A1}$ represents a phenyl group substituted by at least one halogen atom, and these phenyl groups include those further having a substituent(s) other than a halogen atom.

$R_{A2}$ has the same meaning as that of $R^1$ of the above formula (C-II). $X_A$ represents a halogen atom, an aryloxy group or an alkoxy group including those having a substituent(s).

As a representative specific example of the cyan coupler represented by the formula (C-II), there may be mentioned Exemplary compounds C-1 to C-25 disclosed in Japanese Provisional Patent Publication No 96656/1988, Exemplary compounds PC-II-1 to PC-II-31 disclosed on pages 124 to 127 of Japanese Provisional Patent Publication No. 156748/1989, and further, the 2,5-diacylamino type cyan couplers disclosed on page 7, right lower column to page 9, left lower column of Japanese Provisional Patent Publication No. 178962/1987, page 7, left lower column to page 10, right lower column of Japanese Provisional Patent Publication No. 225155/1985, page 6, left upper column to page 8, right lower column of Japanese Provisional Patent Publication No. 222853/1985 and page 6, left lower column to page 9, left upper column of Japanese Provisional Patent Publication No. 185335/1984.

The hydrophobic compound such as the above dye-forming coupler may be generally added to a desired hydrophilic colloid layer by dissolving it in a high boiling point organic solvent having a boiling point of 150° C. or higher or a water-insoluble high-molecular compound by using a low boiling point and/or water-soluble organic solvent in combination, if necessary, and emulsifying and dispersing the solution in a hydrophilic binder such as a gelatin aqueous solution by using a surfactant with a dispersing means such as a stirrer, a homogenizer, a colloid mill, a flow jet mixer and an ultrasonic device.

In the present invention, the high boiling point organic solvent having a dielectric constant of less than 6.0 is preferably used.

The lowest limit is not particularly limited, but the dielectric constant is preferably 1.9 or more. For example, esters such as phthalate and phosphate, organic acid amides, ketones and hydrocarbon compounds each having a dielectric constant of less than 6.0 are included. As a specific example of the high boiling point organic solvent, there may be mentioned Exemplary organic solvents 1 to 22 disclosed on page 41 of Japanese Provisional Patent Publication No. 166331/1987.

In the light-sensitive silver halide photographic material according to the present invention, there may be used a water-soluble dye, a color antifoggant, an image stabilizer, a hardener, a plasticizer, a polymer latex, a UV absorber, a formalin scavenger, a mordant, a development accelerator, a development retarder, a fluorescent brightener, a matting agent, a lubricant, an antistatic agent and a surfactant as desired.

The photographic constitutional layer of the light-sensitive silver halide photographic material according to the present invention may be coated on a baryta paper, a paper laminated with an α-olefin polymer and a paper support in which a paper support and an α-olefin layer can be easily peeled off; a flexible reflective support such as a synthetic paper; a reflective support of a film comprising a semisynthetic or synthetic polymer such as cellulose acetate, cellulose nitrate, polystyrene, polyvinyl chloride, polyethylene terephthalate, polycarbonate and polyamide with a white pigment contained in or coated on the film; and a rigid body such as metal and ceramic. A thin reflective support having a thickness of 120 to 160 μm may be also used.

As the white pigment, there may be used inorganic and/or organic white pigments, preferably an inorganic white pigment, for example, sulfate of an alkaline earth metal such as barium sulfate, carbonate of an alkaline earth metal such as calcium carbonate, silicas such as fine powder of silicic acid and synthetic silicate, calcium silicate, alumina, alumina hydrate, titanium oxide, zinc oxide, talc and clay. The white pigment is preferably barium sulfate and titanium oxide.

The light-sensitive silver halide photographic material according to the present invention may be coated directly or through a subbing layer (at least one subbing layer for improving adhesion property of a support surface, antistatic property, dimensional stability, friction resistance, hardeness, antihalation property, friction characteristic and/or other characteristics) after the support surface is subjected to corona discharging, irradiation of UV ray and flame treatment, if necessary.

When the light-sensitive photographic material using the silver halide emulsion according to the present invention is coated, a thickener may be used for improving coatability. As the coating method, there may be particularly useful extrusion coating and curtain coating by which two or more layers can be coated at the same time. The light-sensitive material of the present invention can form an image by carrying out color development processing known in this field of the art.

In the present invention, as a color developing agent used in a color developing solution, there may be included aminophenol type and p-phenylenediamine type derivatives widely used in various color photographic processes.

To the color developing solution suitably used in processing of the light-sensitive material of the present invention, there may be added a known compound as a component for the developing solution in addition to the above aromatic primary amine type color developing agent.

The pH value of the color developing solution is generally 9 or more, preferably about 10 to 13.

The color development temperature is normally 15° C. or higher, generally in the range of 20° C. to 50° C.

For rapid processing, the color development is preferably carried out at 30° C. or higher.

Further, the development processing time is generally 10 seconds to 4 minutes. However, for the purpose of rapid processing, the development processing is preferably carried out for 10 seconds to 1 minute, and when more rapid processing is demanded, the development processing is preferably carried out for 10 to 30 seconds. When such a rapid processing is carried out, the effect of the present invention can be exhibited more efficiently.

When the light-sensitive material of the present invention is subjected to running processing by replenishing a color developing replenishing solution continuously, the amount of the color developing solution to be replenished is preferably 20 to 150 ml, more preferably 20 to 120 ml, further preferably 20 to 100 ml per 1 $m^2$ of the light-sensitive material. When such a low replenishing running processing is carried out, the effect of the present invention can be exhibited more efficiently. The light-sensitive material of the present invention is subjected to bleach-fixing processing after color development.

After bleach-fixing processing, washing processing or stabilizing processint, or a combination of both processings is generally carried out.

EXAMPLES

In the following, the present invention is described in detail by referring to Examples, but the embodiment of the present invention is not limited by these.

Example 1

To a gelatin aqueous solution containing sodium chloride were added an aqueous solution containing potassium bromide and sodium chloride at a molar ratio of 1:99 and a silver nitrate aqueous solution under vigorous stirring conditions, to prepare a silver chlorobromide emulsion (silver chloride content: 99 mole %, average grain size: 0.45 μm, variation coefficient: 9%) by a double-jet method.

This emulsion was apportioned and optimumly sensitized by adding sodium thiosulfate, sodium chloroaurate, and the sensitizing dyes and supersensitizers shown in Table 1 at 65° C. to obtain Em-1 to Em-15.

Subsequently, the cyan couplers CC-1 and CC-2, and the antistaining agent HQ-1 and the dye image stabilizer ST-1 were dissolved in a mixture of dioctyl phthalate (DOP) and ethyl acetate, and the solution was emulsified and dispersed in a 8% gelatin aqueous solution containing Alkanol B (trade name, produced by Du Pont Co.).

The above emulsions Em-1 to Em-15 were mixed with this emulsified dispersion, respectively, to prepare coating solutions, and the coating solutions were coated on a paper support having the both surfaces coated with polyethylene to prepare Samples 101 to 115. As a protective layer, gelatin was coated, and in the protective layer, 2,4-dichloro-6-hydroxy-s-triazine sodium (H-1) was contained as a hardener.

The coating components and amounts thereof are shown in Table 3.

| | | Amount added ($g/m^2$) |
|---|---|---|
| Protective layer | Gelatin | 1.0 |
| Red-sensitive layer | Silver chlorobromide emulsion (Em-1 to Em-10) | 0.3 on silver |
| | Cyan coupler (CC-1) | 0.3 |
| | Cyan coupler (CC-2) | 0.1 |
| | Dye image stabilizer (ST-1) | 0.2 |
| | Antistaining agent (HQ-1) | 0.01 |
| | DOP | 0.2 |
| | Gelatin | 1.0 |
| Support | Polyethylene-laminated paper | |

TABLE 3

| Emuslion No. | Sensitizing dye Exemplary No. | Sensitizing dye Amount added (mole/mole of silver) | Supersensitizer Exemplary No. | Supersensitizer Amount added (g/mole of silver) |
|---|---|---|---|---|
| Em-1 (Comparative) | II-1 | $4 \times 10^{-5}$ | — | — |
| Em-2 (Comparative) | II-1 | $4 \times 10^{-5}$ | Comparative compound (A) | 0.70 |
| Em-3 (Comparative) | II-1 | $4 \times 10^{-4}$ | Comparative compound (B) | 0.70 |
| Em-4 (Present invention) | II-1 | $4 \times 10^{-4}$ | S-37 | 0.70 |
| Em-5 (Present invention) | II-1 | $4 \times 10^{-5}$ | S-16 | 0.70 |
| Em-6 (Present invention) | II-1 | $4 \times 10^{-5}$ | S-32 | 0.70 |
| Em-7 (Present invention) | II-1 | $4 \times 10^{-5}$ | S-19 | 0.70 |
| Em-8 (Present invention) | II-14 | $4 \times 10^{-5}$ | S-5 | 0.70 |
| Em-9 (Present invention) | II-19 | $4 \times 10^{-5}$ | S-27 | 0.70 |
| Em-10 (Present invention) | I-7 | $4 \times 10^{-5}$ | S-11 | 0.70 |
| Em-11 (Present invention) | I-7 | $4 \times 10^{-5}$ | S-15 | 0.70 |
| Em-12 (Present invention) | I-7 | $4 \times 10^{-5}$ | S-38 | 0.70 |
| Em-13 (Present invention) | II-14 | $4 \times 10^{-5}$ | S-19 | 0.70 |
| Em-14 (Present invention) | II-19 | $4 \times 10^{-5}$ | S-19 | 0.70 |
| Em-15 (Present invention) | I-7 | $4 \times 10^{-5}$ | S-19 | 0.70 |

Comparative compound (A)

Condensate of phenol and hexamethylenetetramine

Comparative compound (B)

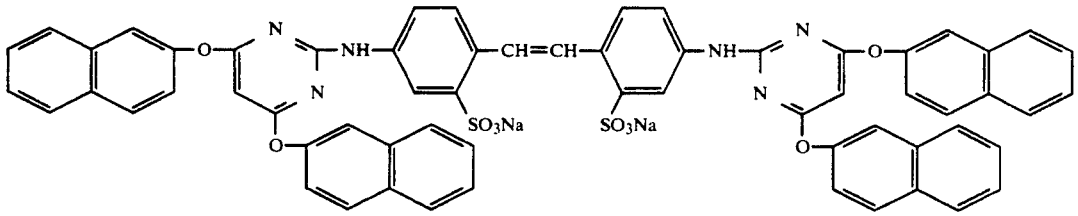

CC-1

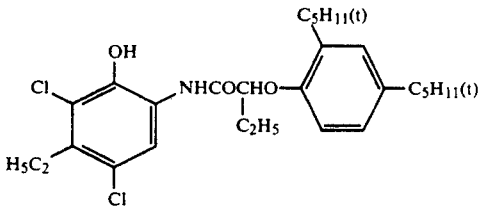

CC-2

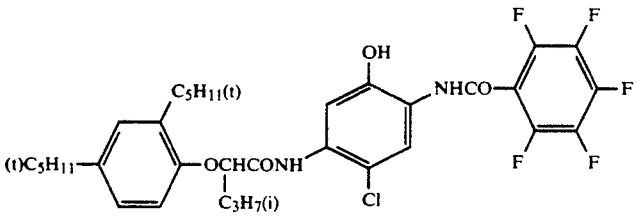

ST-1

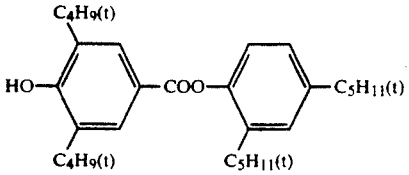

-continued

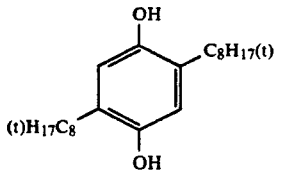

HQ-1

For the samples thus obtained, sensitometry was conducted by the following method, and the relative sensitivity and storage stability of a raw sample were evaluated.

Evaluation of relative sensitivity

After the respective samples were subjected to gradation exposure for sensitometry through a red filter for 0.5 second, the following development processings were carried out. For the samples obtained, the density was measured by an optical densitometer, Model PDA-65 (trade name, manufactured by Konica Corporation), and the sensitivities were compared between the respective samples to obtain relative sensitivity.

Evaluation of storage stability of raw sample

After the respective samples were stored under circumstances of at 25° C. and 60% RH (relative humidity) for 3 months, exposure and processings were carried out in the same manner as described above.

Evaluation of safelight safety characteristics

The change in density (ΔD(s)) of the coated sample after storing for a long time exposed to light at an exposure dose which gave a density of 1.0 when the sample not stored was exposed was measured.

The results thus obtained are shown in Table 4.

TABLE 4

| Sample No. | Sensitizing dye | Supersensitizer | Relative sensitivity | Storage stability of raw smaple (ΔD) | Safelight safety characteristics (ΔD)(s)) |
|---|---|---|---|---|---|
| 101 (Comparative) | II-1 | — | 100 | 0.17 | 0.05 |
| 102 (Comparative) | II-1 | Comparative compound (A) | 245 | 0.28 | 0.19 |
| 103 (Comparative) | II-1 | Comparative compound (B) | 183 | 0.23 | 0.15 |
| 104 (Present invention) | II-1 | S-37 | 173 | 0.09 | 0.14 |
| 105 (Present invention) | II-1 | S-16 | 210 | 0.08 | 0.08 |
| 106 (Present invention) | II-1 | S-32 | 220 | 0.09 | 0.08 |
| 107 (Present invention) | II-1 | S-19 | 258 | 0.07 | 0.04 |
| 108 (Present invention) | II-1 | S-5 | 238 | 0.09 | 0.04 |
| 109 (Present invention) | II-1 | S-27 | 260 | 0.07 | 0.03 |
| 110 (Present invention) | II-1 | S-11 | 253 | 0.09 | 0.04 |
| 111 (Present invention) | II-1 | S-15 | 243 | 0.08 | 0.05 |
| 112 (Present invention) | II-1 | S-38 | 252 | 0.08 | 0.05 |
| 113 (Present invention) | II-14 | S-19 | 261 | 0.08 | 0.04 |
| 114 (Present invention) | II-19 | S-19 | 255 | 0.08 | 0.04 |
| 115 (Present invention) | II-7 | S-19 | 257 | 0.09 | 0.04 |

When a value of ΔD(s) is smaller, safelight safety characteristics are more excellent.

-continued

| Processing step | Temperature | Time |
|---|---|---|
| Color developing | 35.0 ± 0.3° C. | 45 sec |
| Bleach-fixing | 35.0 ± 0.5° C. | 45 sec |
| Stabilizing | 30–34° C. | 90 sec |
| Drying | 60–80° C. | 60 sec |

Color developing solution

| | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Disodium catechol-3,5-diphosphonate | 1.0 g |
| N-Ethyl-N-β-methanesulfonamidoethyl-3-methyl-4-aminoaniline sulfate | 4.5 g |
| Fluorescent brightener (4,4'-diaminostilbene-disulfonic acid derivative) | 1.0 g |
| Potassium carbonate | 27 g |
| Made up to 1 liter in total with addition of water, and adjusted to pH = 10.10. | |

Bleach-fixing solution

| | |
|---|---|
| Ferric ammonium ethylenediaminetetraacetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |
| Made up to 1 liter in total with addition of water, and adjusted to pH = 5.7 with potassium carbonate or glacial acetic acid. | |

Stabilizing solution

| | |
|---|---|
| 5-Chloro-2-methyl-4-isothiazolin-3-one | 1.0 g |
| Ethylene glycol | 1.0 g |
| 1-Hydroxyethylidene-1,1-diphosphonic acid | 2.0 g |

-continued

| | |
|---|---|
| Ethylenediaminetetraacetic acid | 1.0 g |
| Ammonium hydroxide (20% aqueous solution) | 3.0 g |
| Fluorescent brightener (4,4'-diaminostilbene-disulfonic acid derivative) | 1.5 g |
| Made up to 1 liter in total with addition of water, and adjusted to pH = 7.0 with sulfuric acid or potassium hydroxide. | |

As clearly seen from Table 4, it can be understood that by using the macrocyclic compound having a hetero atom disclosed in the present invention as a supersensitizer, high sensitivity can be maintained, storage stability of a raw sample can also be extremely improved, and at the same time, safelight safety characteristics are improved.

Example 2

To a gelatin aqueous solution containing potassium bromide were added an aqueous solution containing potassium bromide and sodium chloride at a molar ratio of 70:30 and a silver nitrate aqueous solution under vigorous stirring conditions to prepare a silver chlorobromide emulsion (silver bromide content: 70 mole %, average grain size: 0.45 μm, variation coefficient: 9%) by a double-jet method. The emulsion was sensitized in the same manner as in Example 1 except for using this emulsion to prepare Em-16 to Em-25 (provided that, in the sensitization, sodium chloroaurate was omitted). In the same manner as in Example 1, a support was coated, and the relative sensitivity and storage stability of a raw sample were evaluated.

However, the following processing steps were carried out.

| (Processing step) | Processing time | Temperature |
|---|---|---|
| Color developing | 3.5 min | 33° C. |
| Bleach-fixing | 1.5 min | 33° C. |
| Washing | 3 min | 33° C. |
| Drying | — | 80° C. |

| (Composition of color developing solution) | |
|---|---|
| Pure water | 700 ml |
| Benzyl alcohol | 15 ml |
| Diethylene glycol | 15 ml |
| Hydroxylamine sulfate | 2 g |
| N-Ethyl-N-β-methanesulfonamidoethyl-3-methyl-4-aminoaniline sulfate | 4.4 g |
| Potassium carbonate | 30 g |
| Potassium bromide | 0.4 g |
| Potassium chloride | 0.5 g |
| Potassium sulfite | 2 g |
| Made up to 1 liter with addition of pure water (pH = 10.2). | |
| (Composition of bleach-fixing solution) | |
| Iron ammonium ethylenediaminetetraacetate | 61 g |
| Diammonium ethylenediaminetetraacetate | 5 g |
| Ammonium thiosulfate | 125 g |
| Sodium metabisulfite | 13 g |
| Sodium sulfite | 2.7 g |
| Made up to 1 liter with addition of water (pH = 7.2). | |

From the obtained evaluation results of relative sensitivity and storage stability of raw sample, the emulsion supersensitized by the macrocyclic compound having a hetero atom according to the present invention had high sensitivity, and improved storage stability and safelight safety characteristics. From the present Example, it can be seen that the effect of the present invention can be obtained in spite of the composition of silver halide.

Example 3

On a paper support having one surface laminated with polyethylene and another surface (a surface where a photographic constitutional layer is to be provided by coating) laminated with polyethylene containing titanium oxide, the respective layers having the following constitutions were provided by coating to prepare multilayer light-sensitive silver halide color photographic material Sample 201. The coating solutions were prepared as described below.

First layer coating solution

Ethyl acetate (60 m) was added to 26.7 g of a yellow coupler (YY-1), 10.0 g of a dye image stabilizer (ST-1), 6.67 g of ST-2, 0.67 g of an additive (HQ-1) and 6.67 g of a high boiling point organic solvent (DNP) to dissolve the mixture, and the solution was emulsified and dispersed in 220 ml of a 10% gelatin aqueous solution containing 7 ml of a 20% surfactant (SU-1) by means of an ultrasonic homogenizer to prepare a yellow coupler dispersion. To the dispersion was added an antifungal agent (B-1). The dispersion was mixed with a blue-sensitive silver halide emulsion prepared under the following conditions to prepare a first layer coating solution.

| Layer | Constitution | Amount added ($g/m^2$) |
|---|---|---|
| Seventh layer (Protective layer) | Gelatin | 1.0 |
| Sixth layer (UV absorbing layer) | Gelatin | 0.4 |
| | UV absorber (UV-1) | 0.10 |
| | UV absorber (UV-2) | 0.04 |
| | UV absorber (UV-3) | 0.16 |
| | Antistaining agent (HQ-1) | 0.01 |
| Sixth layer (UV absorbing layer) | DNP | 0.2 |
| | PVP | 0.03 |
| Fifth layer (Red-sensitive layer) | Gelatin | 1.00 |
| | Red-sensitive silver chlorobromide emulsion (Em-1) | 0.24 calculated on silver |
| | Cyan coupler (CC-1) | 0.29 |
| | Cyan coupler (CC-2) | 0.10 |
| | Dye image stabilizer (ST-1) | 0.20 |
| | Antistaining agent (HQ-1) | 0.01 |
| | HBS-1 | 0.20 |
| | DOP | 0.20 |
| Fourth layer (UV absorbing layer) | Gelatin | 0.94 |
| | UV absorber (UV-1) | 0.28 |
| | UV absorber (UV-2) | 0.09 |
| | UV absorber (UV-3) | 0.38 |
| | Antistaining agent (HQ-1) | 0.03 |
| | DNP | 0.40 |
| Third layer (Green-sensitive layer) | Gelatin | 1.40 |
| | Green-sensitive silver chlorobromide emulsion | 0.36 calculated on silver |
| | Magenta coupler (MM-1) | 0.35 |
| | Dye image stabilizer (ST-3) | 0.15 |
| | Dye image stabilizer (ST-4) | 0.15 |
| | Dye image stabilizer (ST-5) | 0.15 |
| | DNP | 0.20 |
| Second layer (Intermediate layer) | Gelatin | 1.20 |
| | Antistaining agent (HQ-2) | 0.12 |
| | DIDP | 0.15 |
| First layer (Blue-sensitive layer) | Gelatin | 1.20 |
| | Blue-sensitive silver chlorobromide emulsion | 0.30 calculated on silver |
| | Yellow coupler (YY-1) | 0.80 |
| | Dye image stabilizer (ST-1) | 0.30 |
| First layer (Blue-sensitive layer) | Dye image stabilizer (ST-2) | 0.20 |
| | Antistaining agent (HQ-1) | 0.02 |
| | DNP | 0.20 |
| Support | Polyethylene-laminated | |

-continued

| Layer | Constitution | Amount added ($g/m^2$) |
|---|---|---|
| | paper | |

As a hardener, H-2 was added to the second layer and the fourth layer, and H-1 was added to the seventh layer.

Samples 202 to 206 were prepared in the same manner as in the case of Sample 201 except for changing the emulsion used in the red-sensitive layer as shown in Table 5.

Preparation of blue-sensitive emulsion

To a silver chlorobromide emulsion (silver chloride content; 99.8 mole %, average grain size: 0.70 μm, variation coefficient: 7%) were added sodium thiosulfate and the following sensitizing dye (BS) in an amount of $4\times10^{-4}$ mole per mole of silver, and the mixture was optimumly sensitized at 60° C.

Preparation of green-sensitive emulsion

To a silver chlorobromide emulsion (silver chloride content: 99.5 mole %, average grain size: 0.40 μm, variation coefficient: 8%) were added sodium thiosulfate, sodium chloroaurate and the following sensitizing dye (GS) in an amount of $3\times10^{-4}$ mole per mole of silver, and the mixture was optimumly sensitized at 65° C.

YY-1

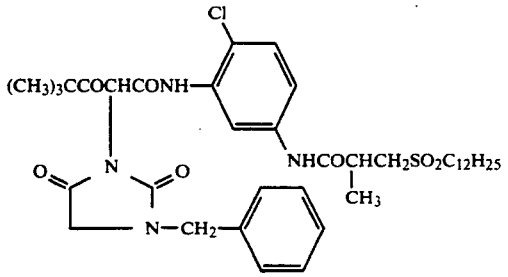

MM-1

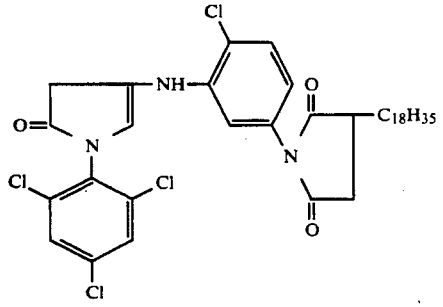

ST-2

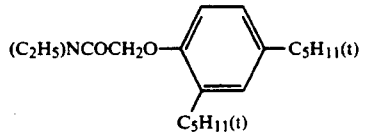

ST-3

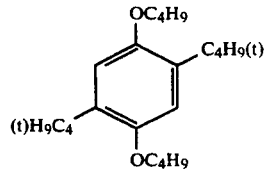

ST-4

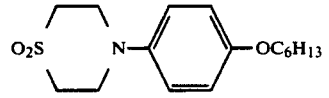

ST-5

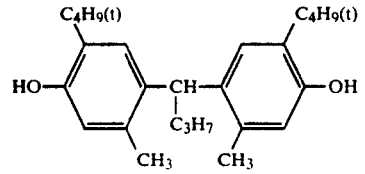

-continued
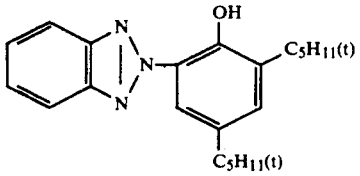
UV-1
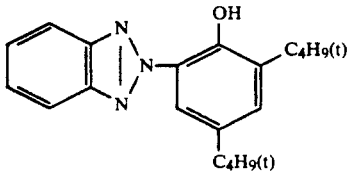
UV-2
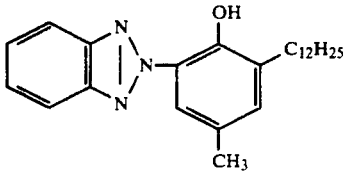
UV-3
| | |
|---|---|
| Diisodecyl phthalate | DIDP |
| Polyvinyl pyrrolidone | PVP |
| Dinonyl phthalate | DNP |
| Dioctyl phthalate | DOP |
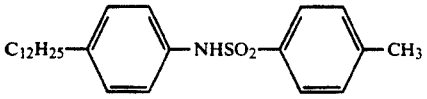
HBS-1
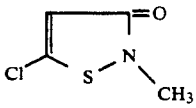
B-1
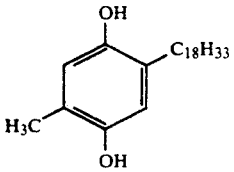
HQ-2
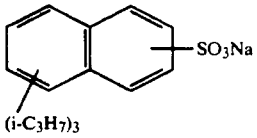
SU-1
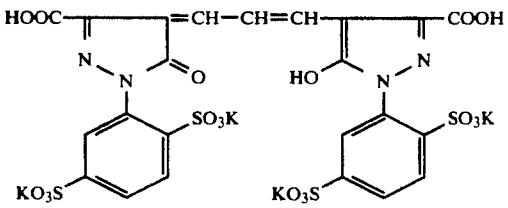
AI-2
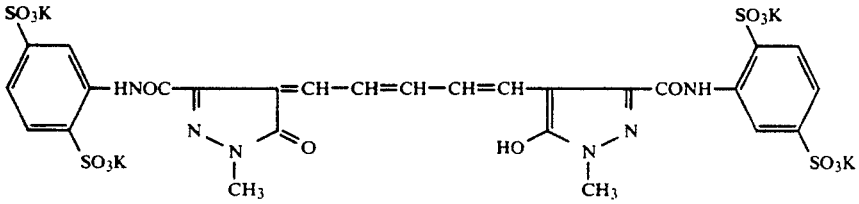
AI-3

-continued

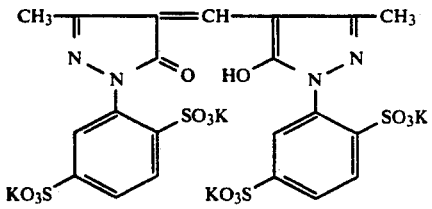

AI-1

$C(CH_2SO_2CH{=}CH_2)_4$ 0.07 g/m²

H-2

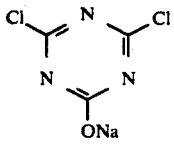

0.05 g/m²

H-1

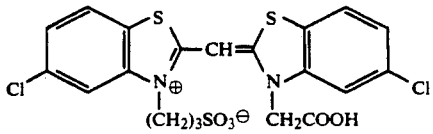

BS

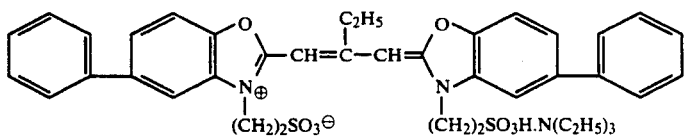

GS

For the samples thus obtained, the relative sensitivity, storage stability of a raw sample and safelight safety characteristics of the red-sensitive layer were evaluated by the method shown in Example 1. The results are shown in Table 5.

TABLE 5

| Sample No. | Red-sensitive emulsion | Relative sensitivity | Storage stability of raw sample (ΔD) | Safelight safety characteristics (ΔD(s)) |
|---|---|---|---|---|
| 201 (Comparative) | Em-1 | 100 | 0.15 | 0.04 |
| 202 (Comparative) | Em-2 | 240 | 0.26 | 0.18 |
| 203 (Comparative) | Em-3 | 180 | 0.22 | 0.14 |
| 204 (Present invention) | Em-4 | 169 | 0.08 | 0.13 |
| 205 (Present invention) | Em-5 | 206 | 0.07 | 0.07 |
| 206 (Present invention) | Em-6 | 218 | 0.07 | 0.07 |
| 207 (Present invention) | Em-7 | 255 | 0.06 | 0.03 |
| 208 (Present invention) | Em-8 | 234 | 0.07 | 0.02 |
| 209 (Present invention) | Em-9 | 257 | 0.06 | 0.02 |

From Table 5, it can be seen that even in the multilayer color printing paper, by using the macrocyclic compound having a hetero atom disclosed in the present invention as a supersensitizer, high sensitivity can be obtained, storage stability of a raw sample can be extremely improved, and safelight safety characteristics can be improved.

According to the present invention, there can be obtained a light-sensitive silver halide photographic material having a red-sensitive silver halide emulsion layer, in which aging storage stability and safelight safety characteristics of a red-sensitive silver halide emulsion are improved and high sensitivity can be maintained stably.

We claim:

1. A light-sensitive silver halide photographic material having at least one layer of a silver halide emulsion on a support, wherein said silver halide emulsion is spectrally sensitized by a red-sensitive sensitizing dye and contains a macrocyclic compound containing an aromatic ring and having at least one hetero atom selected from the group consisting of nitrogen, oxygen, sulfur and selenium.

2. The material of claim 1 wherein a number of aliphatic rings forming the above macrocyclic compound having a hetero atom(s) is 4 or less.

3. In a light sensitive silver halide material having at least one layer comprising a silver halide emulsion carried on a support and wherein said silver halide emulsion is spectrally sensitized by a red sensitive sensitizing dye, the improvement wherein said emulsion being sensitized with the red sensitizing dye further contains at least one macrocyclic compound selected from the group consisting of:

S-1
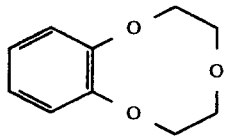
S-2
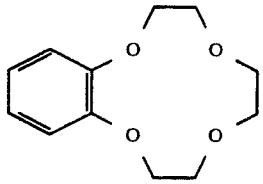
S-3
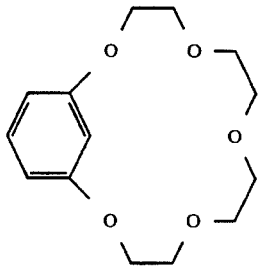
S-4
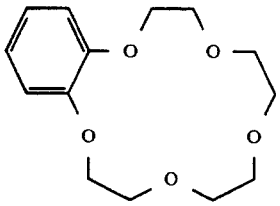
S-5
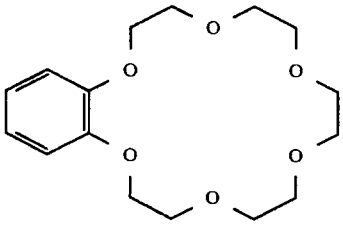
S-6
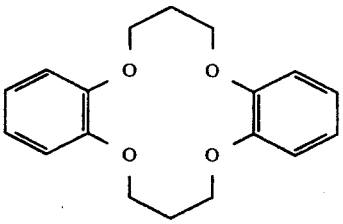
S-7
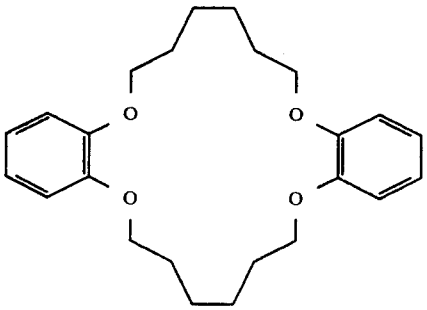

-continued
S-8
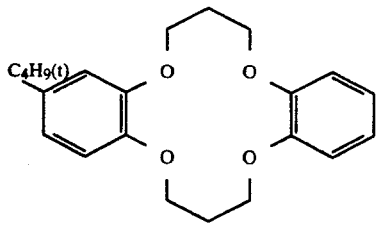
S-9
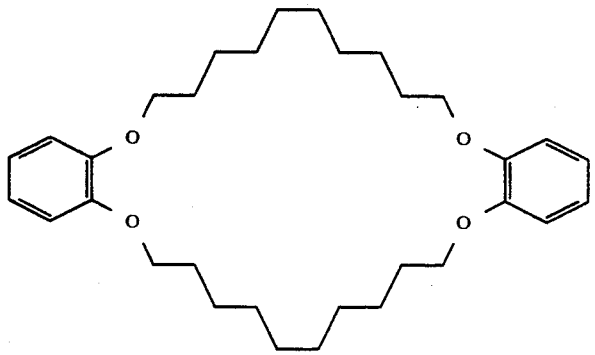
S-10
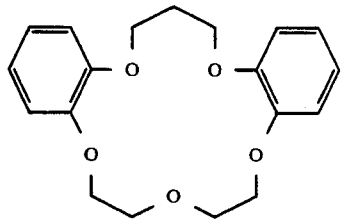
S-11
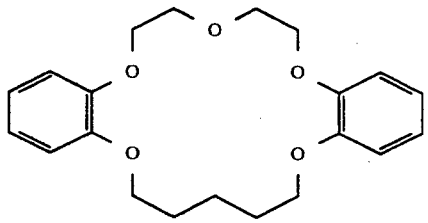
S-12
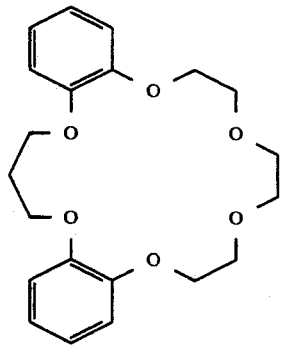
S-13
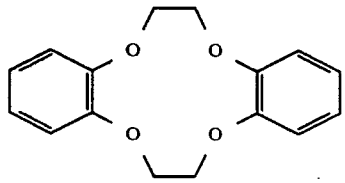

-continued
S-14
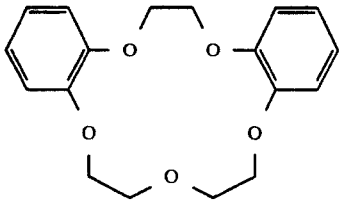
S-15
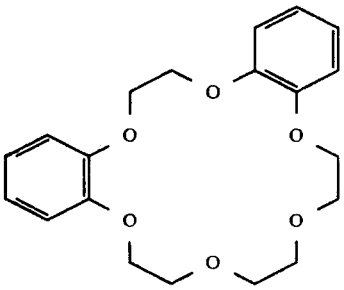
S-16
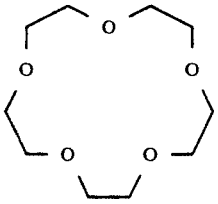
S-17
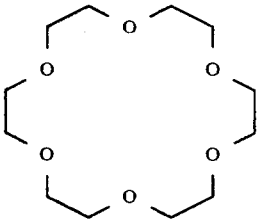
S-18
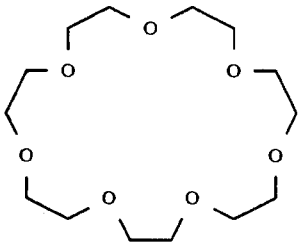
S-19
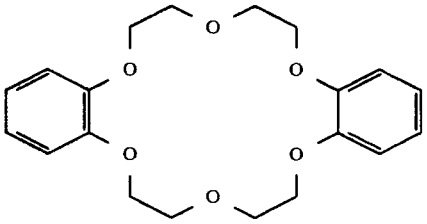

-continued
S-20
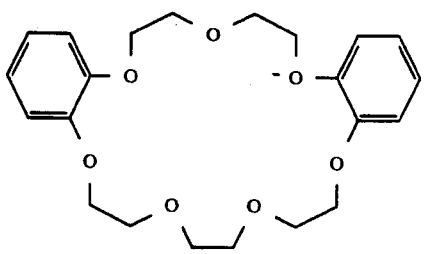
S-21
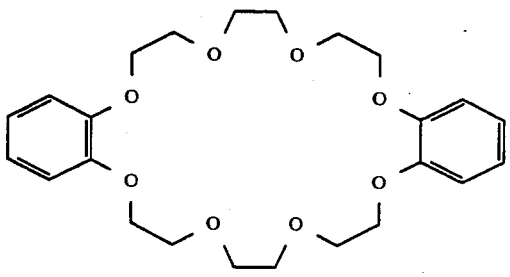
S-22
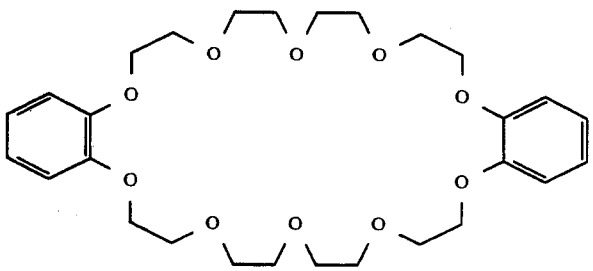
S-23
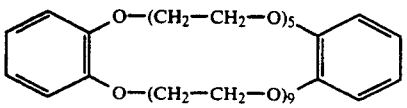
S-24
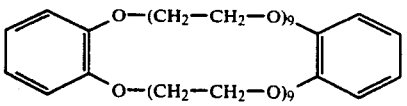
S-25
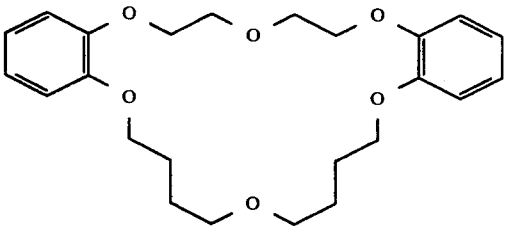
S-26
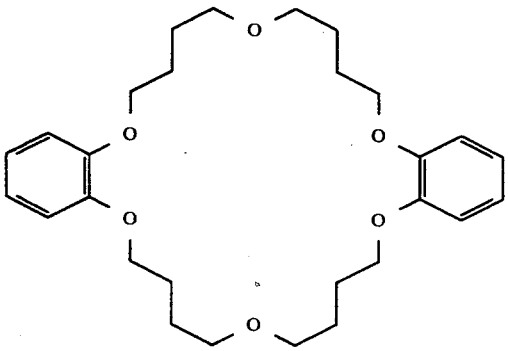

-continued
S-27
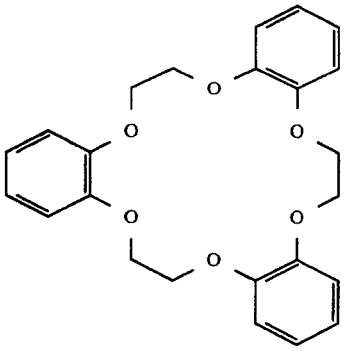
S-28
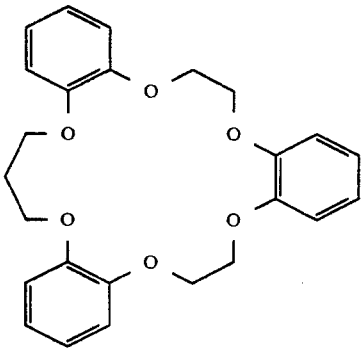
S-29
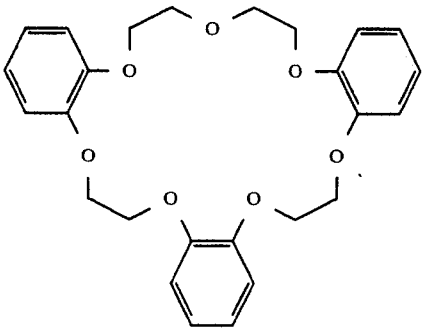
S-30
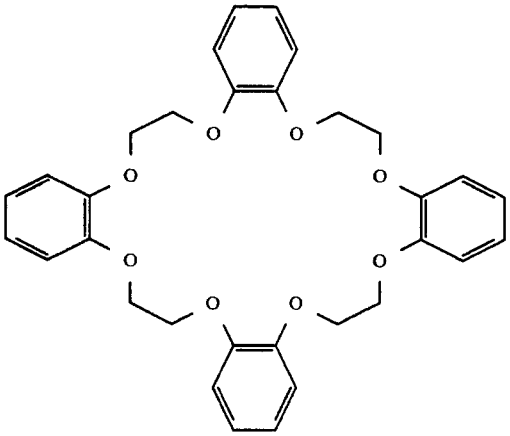

-continued
S-31
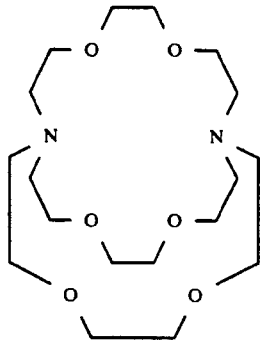
S-32
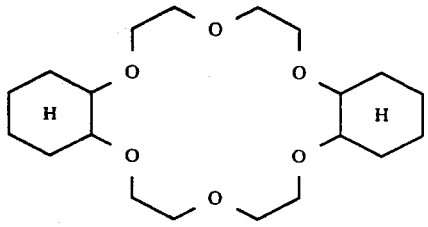
S-33
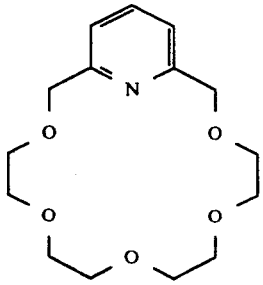
S-34
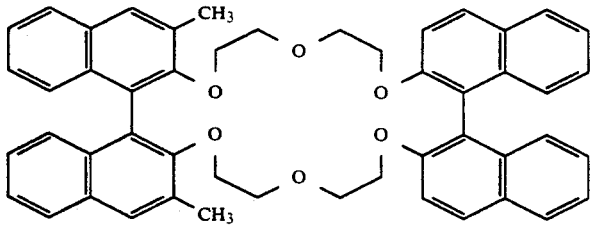
S-35
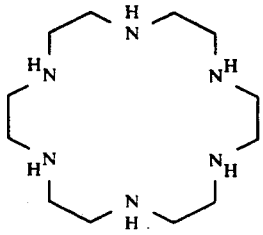

-continued
S-36
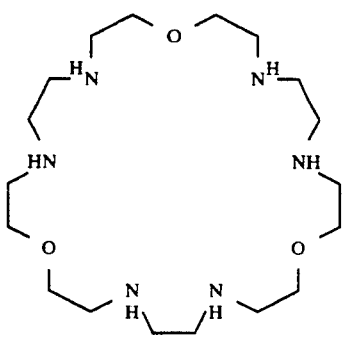
S-37
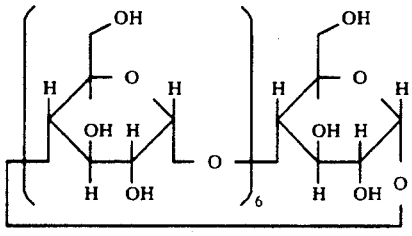
S-38
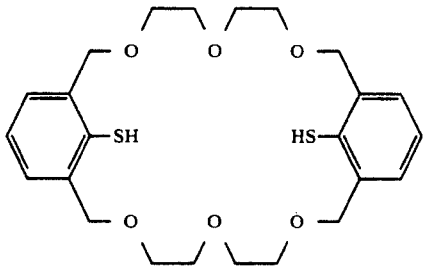
S-39
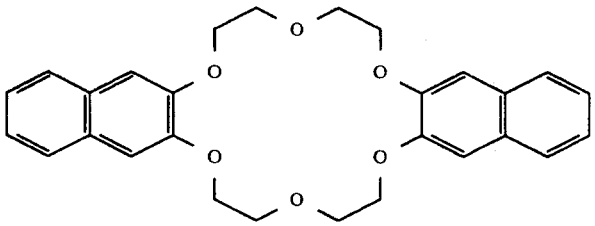
S-40
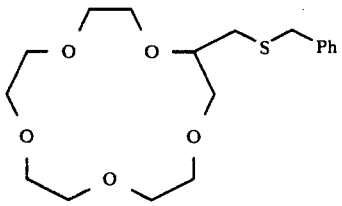
S-41
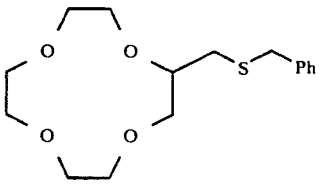

-continued

S-42

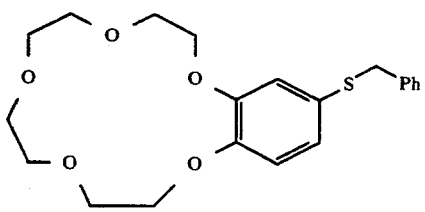

S-43

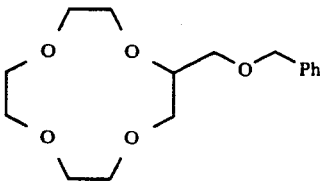

S-44

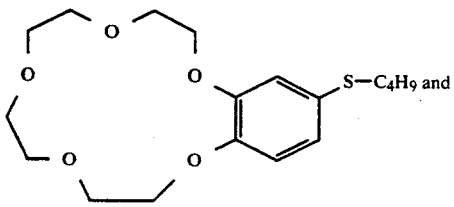

S-45

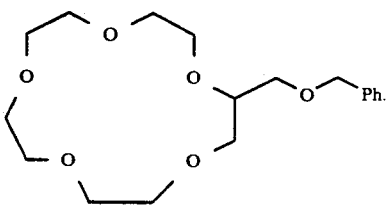

4. The material of claim 3 wherein said red sensitizing dye is present in an amount of $2\times10^{-8}$ to $1\times10^{-2}$ mole per mole silver halide and said macrocyclic compound is present in an amount of $1\times10^{-6}$ to $1\times10^{-1}$ mole per mole silver halide.

5. The material of claim 4 wherein the macrocyclic compound is present in an amount of $5\times10^{-6}$ to $1\times10^{-2}$ mole per mole silver halide.

6. The material of claim 1 or 3 wherein the red-sensitive sensitizing dye is a cyanine dye represented by the following formula (I) or (II):

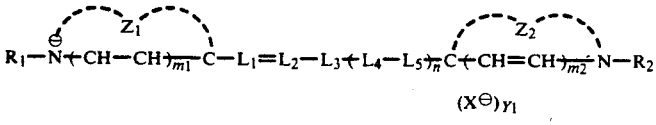

(I)

wherein $R_1$ and $R_2$ each represent an alkyl group, an alkenyl group or an aryl group; $L_1$, $L_2$, $L_3$, $L_4$ and $L_5$ each represent a methyl group; $Z_1$ and $Z_2$ each represent an atom or an atomic group necessary for completing a 5- or 6-membered heterocyclic nucleus; $m_1$ and $m_2$ each represent 0 or 1; n represents 0 or 1; $X^-$ represents an acidic anion; and $Y_1$ represents 0 or 1, and when a compound forms a intramolecular salt, $Y_1$ represents 0

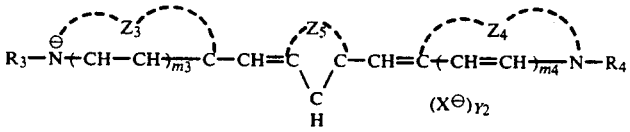

(II)

wherein $R_3$ and $R_4$ each represent an alkyl group, an alkenyl group or an aryl group; $Z_3$ and $Z_4$ each represent an atom or an atomic group necessary for completing a 5- or 6-membered heterocyclic nucleus; $Z_5$ represents a hydrocarbon group necessary for forming a 6-membered ring; $m_3$ and $m_4$ each represent 0 to 1; n represents 0 or 1; $X^-$ represents an acidic anion; and $Y_2$ represents 0 to 1, and when a compound forms a intramolecular salt, $Y_2$ represents 0.

7. The material of claim 6 wherein said red sensitizing dye is present in an amount of $2\times10^{-8}$ to $10^{-2}$ mole per mole silver halide and said macrocyclic compound is present in an amount of $1\times10^{-6}$ to $1\times10^{-1}$ mole per mole silver halide.

8. The material of claim 7 wherein the macrocyclic compound is present in an amount of $5\times10^{-6}$ to $1\times10^{-2}$ mole per mole silver halide.

9. The material of claim 1 or 3 wherein the red-sensitive sensitizing dye is represented by the following formula (III) or (IV):

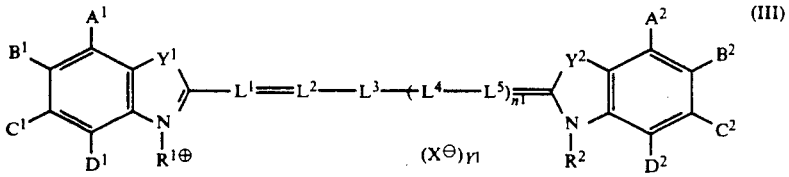

(III)

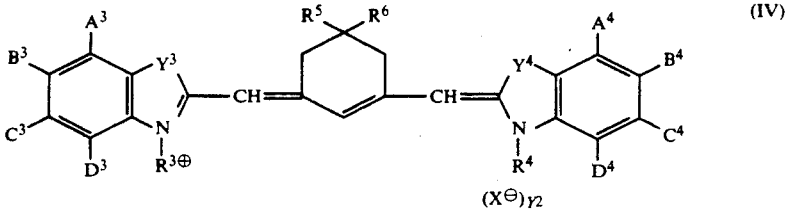

(IV)

wherein $Y^1$, $Y^2$, $Y^3$ and $Y^4$ each represent oxygen atom, sulfur atom or selenium atom; $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ each represent hydrogen atom, a halogen atom, an alkyl group, an alkoxy group, a phenyl group, cyano group, nitro group or an alkoxycarbonyl group, and at least one combination of $A^1$ and $B^1$, $B^1$ and $C^1$, $C^1$ and $D^1$, $A^2$ and $B^2$, $B^2$ and $C^2$, $C^2$ and $D^2$, $A^3$ and $B^3$, $B^3$ and $C^3$, $C^3$ and $D^3$, $A^4$ and $B^4$, $B^4$ and $C^4$, and $C^4$ and $D^4$ may be bonded to form a benzene ring; $R^5$ and $R^6$ each represent a lower alkyl group; $R^1$, $R^2$, $R^3$, $R^4$, $L^1$, $L^2$, $L^3$, $L^4$, $L^5$, $X^-$, $n^1$, $Y^1$ and $Y^2$ each have the same meanings as those of $R_1$, $R_2$, $R_3$, $R_4$, $L_1$, $L_2$, $L_3$, $L_4$, $L_5$, $X^-$, n, $Y_1$ and $Y_2$ in the above formula (I) or (II).

10. The material of claim 9 wherein said red sensitizing dye is present in an amount of $2\times10^{-8}$ to $1\times10^{-2}$ mole per mole silver halide and said macrocyclic compound is present in an amount of $1\times10^{-6}$ to $1\times10^{-1}$ mole per mole silver halide.

11. The material of claim 10 wherein the macrocyclic compound is present in an amount of $5\times10^{-6}$ to $1\times10^{-2}$ mole per mole silver halide.

12. The material of claim 1 or 3 wherein the red-sensitive sensitizing dye is at least one selected from the group consisting of:

TABLE 1

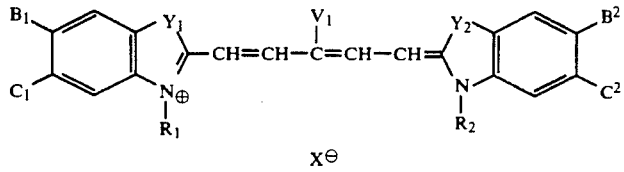

| Exemplary No. | $Y_1$ | $Y_2$ | $B_1$ | $C_1$ | $B_2$ | $C_2$ | $R_1$ | $R_2$ | $V_1$ | $X^-$ |
|---|---|---|---|---|---|---|---|---|---|---|
| I-1 | Se | Se | H | H | H | H | $C_2H_5$ | $C_2H_5$ | H | I |
| I-2 | S | S | H | H | H | H | $C_2H_5$ | $C_2H_5$ | H | I |
| I-3 | Se | Se | H | H | H | H | $(CH_2)_2OCH_3$ | $(CH_2)_2OCH_3$ | H | Br |
| I-4 | Se | S | H | H | H | H | $(CH_2)_3SO_3H$ | $C_2H_5$ | H | — |
| I-5 | S | S | H | $OCH_3$ | H | H | $C_2H_5$ | $C_2H_4OH$ | $C_2H_5$ | Br |
| I-6 | S | S | $C_2H_5$ | H | $C_2H_5$ | H | $C_5H_{11}$ | $C_5H_{11}$ | $C_2H_5$ | Br |
| I-7 | S | S | $C_2H_5$ | H | $C_2H_5$ | H | $C_5H_{11}$ | $C_5H_{11}$ | $C_4H_9$ | Br |
| I-8 | S | S | $OCH_3$ | $OCH_3$ | $OCH_3$ | $OCH_3$ | $C_2H_5$ | $C_2H_5$ | $CH_3$ | I |

I-9

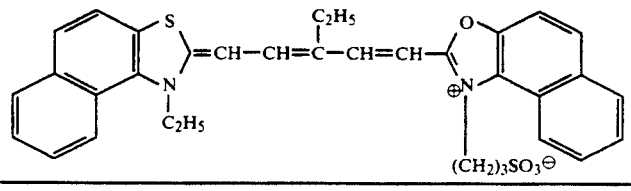

TABLE 2

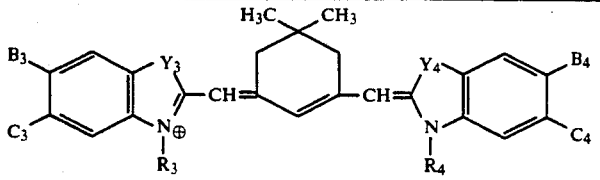

$X^{\ominus}$

| Exemplary No. | $Y_3$ | $Y_4$ | $B_3$ | $C_3$ | $B_4$ | $C_4$ | $R_3$ | $R_4$ | $X^-$ |
|---|---|---|---|---|---|---|---|---|---|
| II-1 | S | S | H | H | H | H | $C_2H_5$ | $C_2H_5$ | Br |
| II-2 | S | S | $CH_3$ | H | H | H | $C_2H_5$ | $C_2H_5$ | Br |
| II-3 | S | S | $CH_3$ | H | $CH_3$ | H | $C_2H_5$ | $C_2H_5$ | I |
| II-4 | S | S | H | H | H | H | $C_2H_5$ | $C_3H_7$ | I |
| II-5 | S | S | H | H | H | H | $C_2H_5$ | $C_4H_9$ | I |
| II-6 | S | S | H | H | H | H | $C_2H_5$ | $C_5H_{11}$ | Br |
| II-7 | S | S | H | H | H | H | $C_2H_5$ | $C_7H_{15}$ | Br |
| II-8 | S | S | H | H | H | H | $C_2H_5$ | $C_{10}H_{21}$ | Br |
| II-9 | S | S | H | H | H | H | $C_3H_7$ | $C_3H_7$ | Br |
| II-10 | S | S | H | H | H | H | $C_4H_9$ | $C_4H_9$ | PTS⁻* |
| II-11 | S | S | H | H | H | H | $C_5H_{11}$ | $C_5H_{11}$ | Br |
| II-12 | S | S | H | H | H | H | $C_7H_{15}$ | $C_7H_{15}$ | Br |
| II-13 | S | S | $CH_3$ | H | H | H | $C_2H_5$ | $C_5H_{11}$ | Br |
| II-14 | S | S | $CH_3$ | H | $CH_3$ | H | $C_2H_5$ | $C_5H_{11}$ | Br |
| II-15 | S | S | $OCH_3$ | H | H | H | $C_2H_5$ | $C_2H_5$ | Br |
| II-16 | S | S | $OCH_3$ | H | H | H | $C_2H_5$ | $C_5H_{11}$ | Br |
| II-17 | S | S | $CH_3$ | $CH_3$ | $CH_3$ | $CH_3$ | $C_2H_5$ | $C_2H_5$ | Br |
| II-18 | S | S | $C_3H_7$(i) | H | $C_3H_7$(i) | H | $C_2H_5$ | $C_2H_5$ | Br |
| II-19 | S | S | H | H | H | H | $C_2H_5$ | $(CH_2)_3SO_3^-$ | — |
| II-20 | S | S | $CH_3$ | H | $CH_3$ | H | $C_2H_5$ | $(CH_2)_4SO_3^-$ | — |
| II-21 | S | S | $CH_3$ | H | $CH_3$ | H | $(CH_2)_3SO_3H.N(C_2H_5)_3$ | $(CH_2)_3SO_3^-$ | — |
| II-22 | S | O | H | H | H | H | $C_2H_5$ | $C_2H_5$ | Br |
| II-23 | S | O | $CH_3$ | H | $CH_3$ | H | $C_2H_5$ | $C_5H_{11}$ | Br |
| II-24 | Se | Se | H | H | H | H | $C_2H_5$ | $C_2H_5$ | Br |
| II-25 | Se | Se | $CH_3$ | H | $CH_3$ | H | $C_2H_5$ | $C_2H_5$ | Br |

II-26

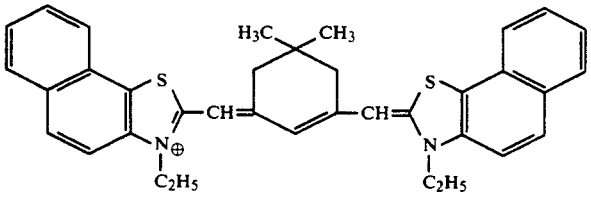

$I^{\ominus}$ and

II-27

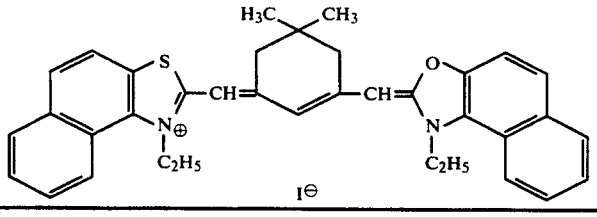

$I^{\ominus}$ (*PTS: paratoluenesulfonic acid)

13. The material of claim 12 wherein said red sensitizing dye is present in an amount of $2\times10^{-8}$ to $1\times10^{-2}$ mole per mole silver halide and said macrocyclic compound is present in an amount of $1\times10^{-6}$ to $1\times10^{-1}$ mole per mole silver halide.

14. The material of claim 13 wherein the macrocyclic compound is present in an amount of $5\times10^{-6}$ to $1\times10^{-2}$ mole per mole silver halide.

* * * * *